US005359337A

United States Patent [19]

Eguchi

[11] Patent Number: 5,359,337

[45] **Date of Patent: * Oct. 25, 1994**

[54] STABILIZED ANTENNA SYSTEM

[75] Inventor: Kouichi Eguchi, Tokyo, Japan

[73] Assignee: Japan Radio Co., Ltd., Tokyo, Japan

[ * ] Notice: The portion of the term of this patent subsequent to Jun. 29, 2010 has been disclaimed.

[21] Appl. No.: 796,704

[22] Filed: Nov. 21, 1991

[30] Foreign Application Priority Data

Nov. 30, 1990 [JP] Japan ..... 2-339317

[51] Int. Cl.[5] ..... H01Q 3/00

[52] U.S. Cl. ..... 343/765; 343/757; 342/359

[58] Field of Search ..... 343/765, 766, 709, 757, 343/878, 872; 342/359, 442, 371, 372; 248/182, 183; H01Q 1/18, 3/00, 3/08

[56] References Cited

U.S. PATENT DOCUMENTS

| | | | |
|---|---|---|---|
| 4,786,912 | 12/1988 | Brown et al. | 343/766 |
| 4,833,932 | 5/1989 | Rogers | 343/765 |
| 4,920,350 | 4/1990 | McGuire et al. | 343/840 |
| 4,994,815 | 2/1991 | Nakayama | 343/765 |
| 5,089,824 | 2/1992 | Uematsu et al. | 343/765 |
| 5,223,845 | 6/1993 | Eguchi | 342/359 |

FOREIGN PATENT DOCUMENTS 8808624 11/1988 PCT Int'l Appl. ..... H01Q 1/18

OTHER PUBLICATIONS

Control Method of 2-Axis Az-El Antenna Mount by Hironori Yuki, Yoshio Karasawa, Takayasu Shiokawa and Hirotaka Takeda in Treatises of Electronic Communications of Feb. 24, 1984 pp. 1-6

Development of a Compact Antenna System for the Inmarsat Standard B Ses in Maritime Satellite Communications by Takayasu Shiokawa et al in Treatises of Electronic Communications Society of Aug. 31, 1984 pp. 17-24.

Phased Array Antenna for Marisat Communications by E. Folke Bolinder in Microwave Journal of Dec. 1978 pp. 39-42.

*Primary Examiner*—Donald Hajec
*Assistant Examiner*—Tan Ho
*Attorney, Agent, or Firm*—Koda and Androlia

[57] ABSTRACT

A stabilized antenna system is installed on a moving platform such as a ship to track a communication satellite. The antenna system examply employs either X1-Y-X2 or Y1-X-Y2 antenna mount. Rolling and pitching of the moving platform are offset by mechanically steering outside and intermediate axes, X1 and X, or Y1 and Y axes. The innermost axis is electronically steered to prevent instability which is caused by the mechanical steering, thereby improving reliability of the antenna system. The frame for rotatable supporting the array antenna is also supported by the radome rotatably. Further, the access hutch for maintainance is opened at the center of the radome and just below the array antenna.

9 Claims, 21 Drawing Sheets

STABILIZED ANTENNA SYSTEM

BACKGROUND OF THE INVENTION

1. Field of the Invention

This invention relates to an antenna system to be used for satellite communications or broadcasting such as INMARSAT system, and more particularly to an antenna system incorporating a stabilization function against inclination of a moving platform.

2. Description of the Related Arts

Heretofore directional antennas have been used to perform maritime satellite communications.

Historically, the maritime communications were started in 1976 by using the American MARISAT system. It was handed over to the internationally organized INMARSAT system in 1982 and has been in operation since then. Antennas having the predetermined directivity are indispensable for such maritime satellite communications.

According to the technical requirements document for the standard-A ship earth station in the present INMARST system as of June 1987, the ship earth station should have G/T of −4 dBK at least. To meet this requirement, a parabolic reflector antenna should have a diameter of about 80 centimeters, for example.

Further, a radome is necessary to make the parabolic reflector antenna resistant to water and rough weathers. The radome should be about 1.2 meters in diameter for the parabolic reflector antenna having 80 centimeters diameter.

Some example of the conventional antenna systems will be described here with reference to the accompanying drawings.

FIGS. 18 and 19 show the configuration of a first conventional antenna system having a radome. The antenna system in these drawing figures is cited as the prior art in the co-pending Japanese Utility Model Application Hei 2-89713. FIG. 18 is a perspective view, and FIG. 19 is a side view.

A parabolic reflector antenna 10 having about 80-cm diameter is covered by a radome 12 made of material which can pass the radio waves whose wavelength is about 1.5 GHz necessary for the satellite communications. The radome 12 is usually made of FRP. The radome 12 has a maximum diameter of about 1.2 meters, and about 1.1 meter diameter at its bottom.

The antenna 10 is supported by a pedestal 14. A DC power source 16 and an power amplifier 18 are mounted on the base of the radome 12. The power amplifier 18 amplifies an output of a receiver 20 (or a receiver front end) mounted on the rear side of the antenna 10, and supplies it as a receiving output to an exterior unit. The DC power source 16 supplies DC power to the receiver 20 and power amplifier 18.

An access hutch 22 is made on the radome base and is about 40 centimeters in diameter. The access hutch 22 is opened and closed for inspection, maintenance and repair of the receiver 20, etc. The antenna system can be attended by exchanging units or connecting measuring instruments through the access hutch 22, for example.

To install such antenna system on a moving platform such as a ship, firstly the radome base is fastened on a support, which is then fixed on a ship deck by a bracket. The antenna system is also suspended by a wire rope to be supported more reliably. To facilitate the maintenance work via the access hutch 22, a platform for the work is usually mounted on the upper part of the support, e.g. about 75 centimeters below the radome base.

The pedestal 14 is fixed on the radome base by its foot. Therefore, the support should be in coaxial with the foot of the pedestal 14 via the radome base.

The antenna system on the moving platform should be steered to track a communication satellite to keep on receiving radio waves under optimum conditions from the satellite. For this purpose, the antenna should be stabilized against inclinations of the moving platform.

Inclinations are caused by rolling and/or pitching. For the stabilization, the antenna should be mechanically or electronically steered in the angular directions. A number of methods have been developed to steer the antenna to stabilize the antenna.

FIG. 20 shows an example of an antenna system in which three axes are mechanically steered.

As shown in FIG. 20, the antenna system includes a dish 24 supported on a ring 26 via an axis. The axis (i.e. dish axis) for the ring 26 to support the dish 24 is connected to a dish axis driving motor 28. Therefore, the dish 24 is set in motion by the dish axis driving motor 28.

The ring 26 is supported to an assembly body 30 via a ring axis, which is connected to a ring axis driving motor 32. The ring 26 is set in motion by the ring axis driving motor 32.

The assembly body 30 is angularly moved by an above-deck electronic assembly 34.

In this conventional example, three axes are mechanically steered. Specifically, the dish 24 is angularly moved about the X, Y and Az axes as shown by lines with arrows.

Therefore, the antenna stabilization is performed by operations of the motor 28, 30 and the assembly 34 when a signal is transmitted or received by the dish 24 via a low noise amplifier (LNA) 36 or 38 and a diplexer (DIP) 38.

In this conventional antenna system, all the three axes are mechanically steered, which complicates design of the system mechanism, making the system large and expensive.

To overcome such inconvenience, an antenna system is proposed, in which two axes are mechanically steered.

FIG. 21 shows the configuration of axes in an Az-El antenna mount.

This mount includes an Az (azimuth) axis which is perpendicular to a horizontal plane and an El (elevation) axis which is parallel to the horizontal plane and is turned by the Az axis.

The following literatures are available concerning the configuration of the Az-El mount: "Control Method of 2-Axis Az-El Antenna Mount", by Yuki et al., Electronic Communications Society, SANE83-53, pp 1–6), and "Development of a Compact Antenna System for INMARSAT Standard-B SES in Maritime Satellite Communications", by Shiokawa et al., Electronic Communications Society, SANE84-19, pp 17–24. These literatures disclose the configuration of apparatuses which were experimentally manufactured by the authors. In these apparatuses, the two axes, Az and El axes, are mechanically steered.

It is possible to stabilize the antenna by foregoing 2-axis configulation while tracking.

However, since the two axes are mechanically steered, a number of measures should be taken to overcome inconveniences related to a singular point.

Specifically, the singular points tends to appear in the direction of the zenith. When the antenna faces to that direction while it is being inclined, a tracking error will be caused. To cope with this singular point, the following measures are taken in the third example of the conventional antenna system: (1) The antenna and its support frame are made of light and rigid material to reduce a load applied to a motor for steering the antenna. A relatively high performance AC servo motor is used together with a high performance AC servo control circuit to steer the antenna. (2) Control software is improved to reduce tracking errors near the singular point.

However since these measures require special material and expensive circuits, the entire antenna system will be expensive. Even if the above-described measure are taken, there are still data that a tracking error of about 10° is inevitable near the zenith.

The foregoing inconveniences can be solved by forming at least one of a plurality of the axes as an electronic axis. The electronic axis is realized by a phased array antenna.

FIG. 22 shows an antenna system including two electronical axes as well as a mechanical axis. Such antenna system is disclosed in "Phased Array Antenna for MARISAT Communications". Folkebolinder, Microwave Journal, 1978, 12, pp 39–42. This array antenna system includes a mechanical axis 42 as an Az axis and a plurality of antenna elements 46 mounted on two plates 44-1, 44-2 (i.e. array antenna) which are phase-shifted to serve as an El axis.

Specifically, the antenna elements 48 are arranged in matrix on the plates 44-1, 44-2. The antenna elements are individually connected to non-illustrated phase shifters whose amount of phase-shift changes in response to control signals. Therefore, when the amount of phase-shift is controlled for each row of the antenna elements on the planes shown by FIG. 22, the beam directivity in a direction parallel to the columns is controlled, thereby forming an El axis as an electronic axis. According to the foregoing literature, the beam directivity is changeable in the range of ±35°. Such electronic El axis is realized by the array antenna and its phase shifters.

Another electronic axis can be realized by the foregoing configuration. Specifically, amount of phase-shift is controlled for each column of antenna elements 46 so that the beam directivity is changed in a direction parallel to the columns, thereby one more electronic axis is realized. Therefore, in the fourth example, the Az-El-El' mount with two electronical axes is realized.

The foregoing antenna systems are covered with radomes, and include a number of driving mechanism according to the axis configuration.

However, even when the electronic axis is used as described above, phase shifters should be provided for each antenna element 46, making the entire antenna system large, complicated and expensive. Therefore, application of the foregoing antenna systems is somewhat limited.

In the co-pending Japanese Utility Model Application Hei 2-89713, a compact and easy-to-maintain antenna system is proposed to improve the first example of the conventional antenna system. The proposal is made to use a compact radome. Although the radome base is reduced in size when an antenna is small, an access hutch is kept large. Specifically, the antenna and the pedestal is eccentically supported on the base with a space maintained above the base.

SUMMARY OF THE INVENTION

With the foregoing inconveniences in view, it is therefore an object of this invention to provide a stabilized antenna system, in which mechanical and electronic axes are used to assure reliable satellite tracking and stabilization, thereby making the system less expensive and easy to maintain. The antenna system is made compact by applying an antenna support structure proposed in the co-pending Japanese Utility Model Application Hei 2-89713.

According to a first aspect of this invention, there is provided a stabilized antenna system to be installed on a moving platform, comprising:

an antenna mount including an antenna, first antenna steering means, a frame and second antenna steering means; first stabilization means for stabilizing the antenna against rolling of the moving platform by controlling a steering angle around a mechanical X1 axis; second stabilization means for stabilizing the antenna against pitching of the moving platform by controlling a steering angle around a mechanical Y axis and a steering angle around a virtual X2 axis; and a radome for covering at least the antenna mount and for supporting the frame internally at the side thereof, said radome being a dome-shaped member made of material passing radio waves.

The antenna mount includes: the antenna for either a high frequency transmission or reception and being capable of steering a beam around the virtual X2 axis electronically; first antenna steering means for steering the antenna around the mechanical Y axis which is perpendicular to the virtual axis; the frame for mounting the first antenna steering means thereon and being made substantially of resin; and the second antenna steering means for steering the frame around the mechanical X2 axis which is parallel to an advancing direction of the moving platform.

According to a second aspect of this invention, there is provided a stabilized antenna system to be installed on the moving platform, comprising:

an antenna mount including an antenna, first antenna steering means, a frame and second antenna steering means; first stabilization means for stabilizing the antenna against pitching of the moving platform by controlling a steering angle around a mechanical Y1 axis; second stabilization means for stabilizing the antenna against rolling of the moving platform by controlling a steering angle around a mechanical X axis and a steering angle around a virtual Y2 axis; and a radome for covering at least the antenna mount and for supporting the frame internally at the side thereof, said radome being made of material passing radio waves.

The antenna mount includes:

the antenna for either a high frequency transmission or reception and being capable of steering a beam around the virtual Y2 axis electronically; the first antenna steering means for steering the antenna around the mechanical X axis which is parallel to the advancing direction of the moving platform; the frame for mounting said first antenna steering means thereon and being made substantially of resin; and the second antenna steering means for steering the frame around the mechanical Y1 axis.

In any of these aspects, stabilization of the antenna installed on the moving platform like a ship is performed.

With the X1-Y-X2 or Y1-X-Y2 mount in which three axes are mechanically steered, there is instability caused by mutual coupling or interferrence between the X1 and X2 axes, or between Y1 axis and Y2 axes. According to this invention, either X2 or Y2 axis is electronically steered to overcome the above-described instability. Thus, the antenna system can be realized less expensively without a complicated driving mechanism.

The first antenna steering means is located on the frame, thereby avoiding inconveniences experienced with wirings when this means is mounted on the array antenna side. The frame made of resin does not adversely affect the transmission and receiving functions of the antenna system.

The radome covers the antenna system to protect it against rainwater and rough weather. The dome-shaped radome is made of material which can pass radio waves. The above-described frame is supported at the side of the radome. Since no metallic members are used to support the frame, the properties of the antenna system are not affected by electric shielding for the metallic support. Therefore, a vacant space in the radome can be made narrow, making the entire system compact.

According to an other aspect of this invention, there is provided a stabilized antenna system to be installed on a moving platform, comprising: an array antenna; first antenna steering means for steering the array antenna around a first mechanical axis perpendicular to a virtual axis for steering a beam by variable phase shifters; second antenna steering means for angularly steering the array antenna and the first antenna steering means around second mechanical axis perpendicular to the first mechanical axis; inclination detecting means for detecting inclination angle of the moving platform; control means for controlling the variable phase shifters and the first and second antenna steering means according to the detected inclination angle so that beam of the array antenna is directed toward a satellite; a dome-shaped radome for covering at least the array antenna and the first and second antenna steering means, the radome being made of material to pass the radio waves; and a frame for supporting the first antenna steering means, the frame being mainly made of resin and being supported at the side of the radome.

The array antenna includes a plurality of antenna elements arranged in a plurality of columns, and variable phase shifters associated with at least respective columns of the antenna elements except for the central column of the antenna elements and being adopted to phase-shift high frequency signals related to the antenna elements in the columns associated therewith, thereby steering the beam electronically around the virtual axis.

This aspect is based on the fact of existence of an array antenna which can steer a beam electronically. One of the objects of the aspect is, therefore, to realize the array antenna which is compact and less-expensive. This object is accomplished by above described structure, especially, the phase shifters respective to the columns. Examply, the control means further includes phase shifter control variable calculating means, first mechanical axis control variable calculating means and second mechanical axis control variable calculating means. Respective calculating means calculate the control variables based on satellite azimuth angle, satellite elevation angle and inclination angle detected. The calculated control variables are supplied to the array antenna and the antenna steering means to control the amount of phase-shift by the variable phase shifters, amount of steering by the first and second antenna steering means.

The first antenna steering means further includes a servo loop composed of a first mechanical axis motor for steering the antenna, first mechanical axis angle detecting means for detecting an angular position of the first mechanical axis motor, and a first mechanical axis control means. In this structure, the first mechanical axis control means controls the first mechanical axis motor in the servo control loop according to the detected angle. Therefore, the first mechanical axis is controlled reliably and accurately.

The same holds true to the second antenna steering means.

The array antenna further includes combiners for combining signals received by the antenna elements, and a receiver front-end for receiving the signals combined. When the variable phase shifters and the combiners are located near the antenna elements, loss related to signal transmission and reception can be minimized.

The radome base is supported by the support at a position eccentric eccentric from the center of the radome base. Therefore, enough space for the access hutch is kept as residual space on the radome base and enough space for inspection and maintainance is kept above the hutch.

BRIEF DESCRIPTION OF THE DRAWINGS

Specifically, FIG. 1 shows the axis configuration of an X1-Y-X2 mount, and FIG. 2 shows the axis configuration of a Y1-X-Y2 mount;

DETAILED DESCRIPTION

The following is a description of preferred embodiments of this invention, with reference to FIG. 1 to FIG. 17.

The principle of the X1-Y-X2 mount and Y1-X-Y2 mounts will be described first.

Two types of the antenna mounts including two parallel axes that causes a singular point, i.e. X1-Y-X2 and Y1-X-Y2 mounts, have been studied by the inventors with respect to their control variables. These mounts are respectively shown in FIGS. 1 and 2.

In the X1-Y-X2 mount, an X1 axis supports an outside frame, a Y axis supports an intermediate frame, and an X2 axis supports an antenna. The X1 and X2 axes are parallel to each other when the antenna is horizontal. The Y axis is perpendicular to the X1 axis. With the Y1-X-Y2 mount, "X" and "Y" axes are exchanged. The X1 axis of the X1-Y-X2 mount and the X axis of the Y1-X-Y2 mount should always face the advancing direction of the moving platform, i.e. the bow of the ship.

Figure 1:
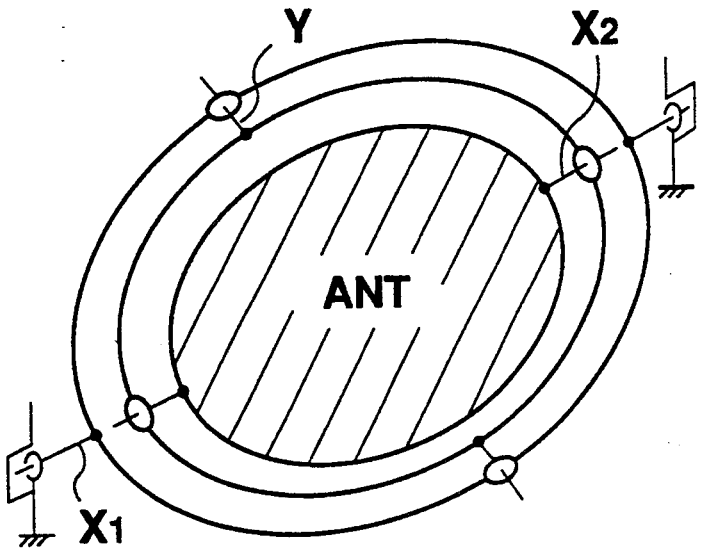
FIGS. 1 and 2 show the principle of antenna stabilization.
Figure 2:
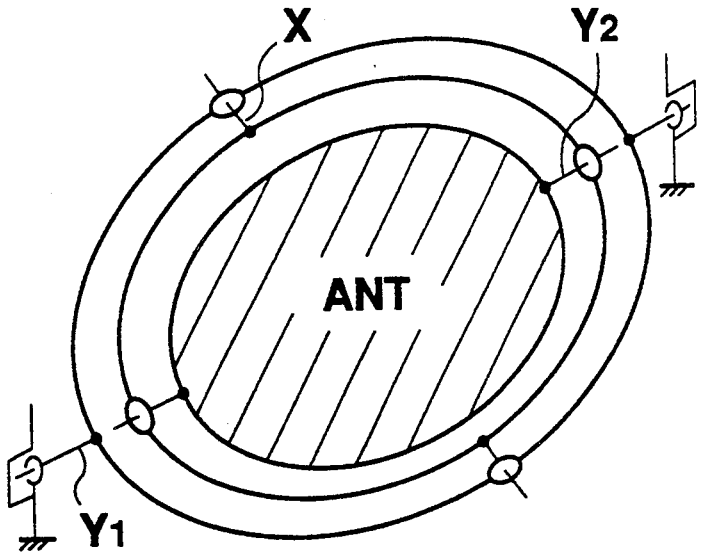

Firstly, discussion is made on stabilization of the X1-Y-X2 mount. The relationship between the axes shown in FIG. 1 is expressed as follows by matrix equation including orthogonal coordinate transformations (rotations) for the pitching and rolling motions.

$$\begin{pmatrix}0\\0\\1\end{pmatrix} = (\xi 2)(\eta)(\xi 10)(P)(R)^{-1}(R)\begin{pmatrix}x0\\y0\\z0\end{pmatrix}$$

where ($\epsilon 2$): a 3×3 matrix representing the coordinate rotation for the control angle of $\epsilon 2$ of the X2 axis; ($\eta$): a 3×3 matrix representing the coordinate rotation for the control angle $\eta$ of the Y axis; ($\epsilon 10$): a 3×3 matrix representing the coordinate rotation for the control angle $\epsilon 10$ of the X1 axis. (P) stands for a 3×3 matrix representing the coordinate rotation for the pitching. (R) stands for a 3×3 matrix representing the coordinate rotation for the rolling. $(\bullet)^{-1}$ denotes a 3×3 inverse matrix of (•). Vector includes components of xo, yo, zo is vector of a satellite direction expressed by the orthogonal coordinate (X0, Y0, Z0). The coordinate (X0, Y0, Z0) is the orthogonal coordinate fixed to the ship's deck when both of roll and pitch angle are equal to 0.

The above expression is modified as:

$$(\xi 10)^{-1}(\eta)^{-1}(\xi 2)^{-1}\begin{pmatrix}0\\0\\1\end{pmatrix} = (P)\begin{pmatrix}x0\\y0\\z0\end{pmatrix}$$

(P) can be expressed as follows by using the pitch angle p:

$$\begin{pmatrix}\cos p & 0 & -\sin p\\ 0 & 1 & 0\\ \sin p & 0 & \cos p\end{pmatrix}$$

Then, the right side of the above expression is rewritten as:

$$(P)\begin{pmatrix}x0\\y0\\z0\end{pmatrix} = \begin{pmatrix}x0\cos p - z0\sin p\\ y0\\ x0\sin p + z0\cos p\end{pmatrix} = \begin{pmatrix}xp\\yp\\zp\end{pmatrix}$$

The left side of the above expression is rewritten as:

$$\begin{pmatrix}\sin\eta\cos\xi 2\\ -\cos\xi 10\sin\xi 2 - \sin\xi 10\cos\eta\cos\xi 2\\ -\sin\xi 10\sin\xi 2 + \cos\eta\cos\xi 10\cos\xi 2\end{pmatrix}$$

When the roll angle r=pitch angle p=0 and $\epsilon 2=0$, replacing $\epsilon 10$ by $\epsilon 0$, $\cos\epsilon 0$ by c0, and $\sin\epsilon 0$ by s0, respectively, the left side is:

$$\begin{pmatrix}\sin\eta\cos\xi 2\\ -c0\sin\xi 2 - s0\cos\eta\cos\xi 2\\ -s0\sin\xi 2 + c0\cos\eta\cos\xi 2\end{pmatrix}$$

Therefore, control variables for the X1. Y and X2 axes can be determined as follows by adding and deducting the right and left sides of the expression.

$$\epsilon 1 = -r + \epsilon 10$$

$$\eta = \tan^{-1}(xp/(c0\cdot zp - so\cdot yp))$$

$$\epsilon 2 = \pm\cos^{-1}(((c0\cdot zp - so\cdot xp)^2 + xp^2)^{\frac{1}{2}})$$

Similarly, with the Y1-X-Y2 mount:

$$\eta 1 = -p + \eta 10$$

$$\epsilon = -\tan^{-1}(yr/(sl\cdot xr + cl\cdot zr))$$

$$\eta 2 = \cos^{-1}(((sl\cdot xr + cl\cdot zr)^2 + yr^2)^{\frac{1}{2}})$$

where cl=cos $\eta 0$; sl=sin $\eta 0$; xr=x0; yr=y0·cosr+zo·sinr; and zr=−yo·sinr+zo·cosr.

Therefore, with the X1-Y-X2 mount including the parallel axes, the antenna is stabilized based on the control variables determined from the foregoing equations. Specifically, the rolling angle r is compensated by the steering angle $\epsilon 1$ of the X1 axis, and the pitching xp, yp, zp are compensated by the steering angel $\eta$ and $\epsilon 2$ of the Y and X2 axes.

The control variables for the Y1-X-Y2 mount will be determined as described above, so that the pitching angle p is compensated by the steering angle $\eta 1$ of the Y1 axis, and the rolling xr, yr, zr are compensated by the steering angle $\epsilon$ and $\eta 2$ of the X and Y2 axes.

Figure 3:
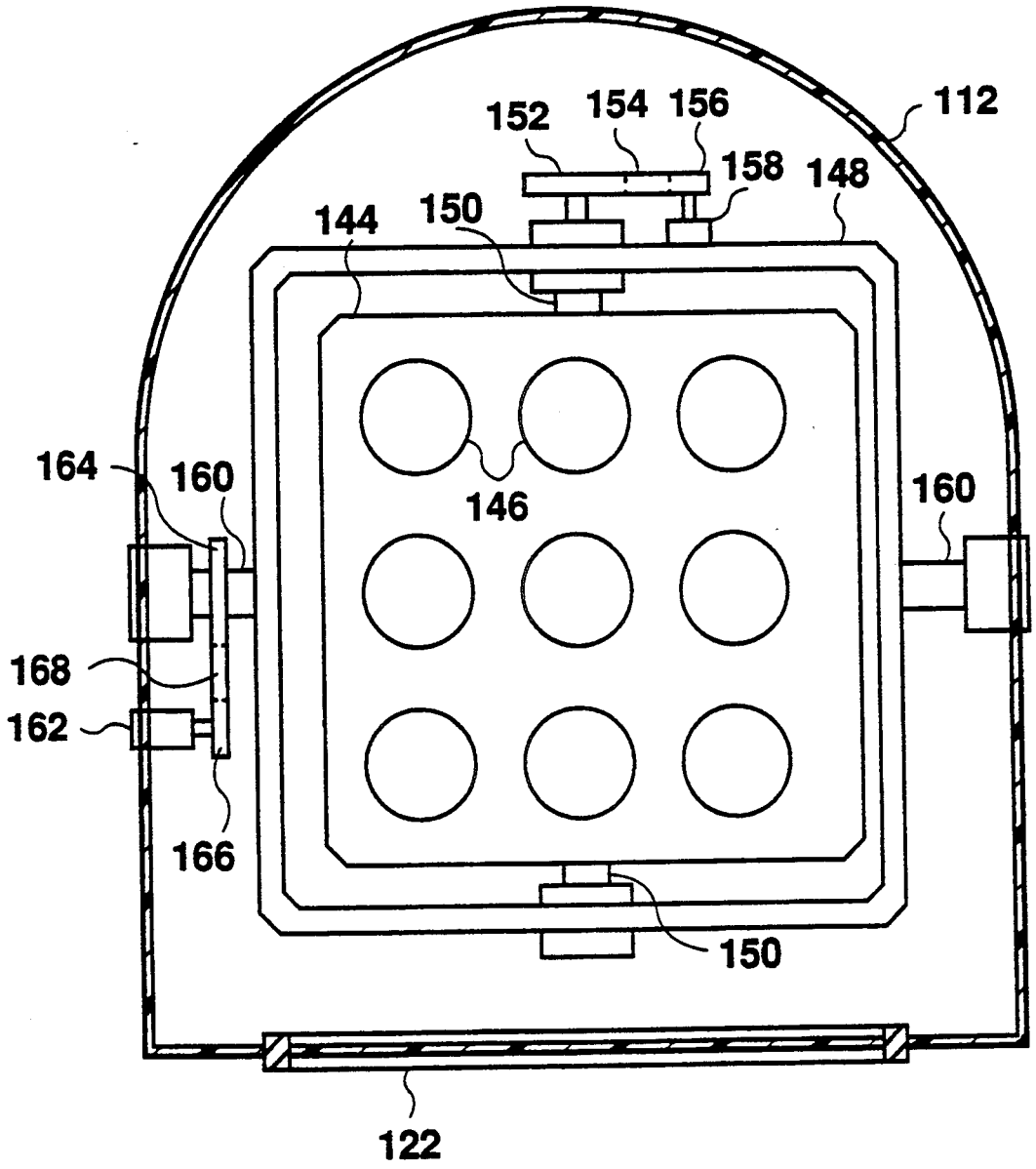
FIG. 3 is a cross-sectional view showing the structure of a stabilized antenna system according to a first embodiment of this invention.

FIG. 3 is a cross-sectional view showing the structure of a stabilized antenna system according a first embodiment, and more particularly components near of the antenna.

As shown in FIG. 3, an array antenna 144 has a total of 9 (3×3) antenna elements 146, and is about 40 cm×40 cm in size. A radome 112 for such array antenna 144 is about 60 cm Φ. Components such as a receiver front end, variable phase shifters (herein-after abbreviated as phase shifters) PS and combiners are mounted on the rear side of the array antenna 144. These components are not shown in FIG. 3. The X2 axis is realized by controlling the phase shifters as described later.

The array antenna 144 is fastened to an X1-axis frame 148 by a Y axis 150. The Y axis 150 is driven by a Y-axis motor 158 via a gear 156, a belt 154 and a gear 152 connected to one end of Y axis 150. In other words, the array antenna 144 is steered about the Y axis 150 in the X1-axis frame 148 by the Y-axis motor 158.

The X1-axis frame 148 is supported on a radome 112 by an X1 axis 160. An X1-axis motor 162 is mounted on an inner surface of the radome 112 at a position below where one end of the X1 axis 160 is attached to the radome 112. The X1 axis 160 and X1-axis motor 162 have gears 164, 166, over which a belt 168 is trained. Therefore, the X1-axis frame 148 and the array antenna 144 supported thereon are steered about the X1 axis 160.

The array antenna 144 includes the X1 axis 160 and Y axis 150 which are mechanically steered. As described later, an X2 axis is electronically steered by phase-shifting control of the array antenna 144. Therefore, the antenna system of this embodiment is of the X1-Y-X2 mount type.

Figure 4:
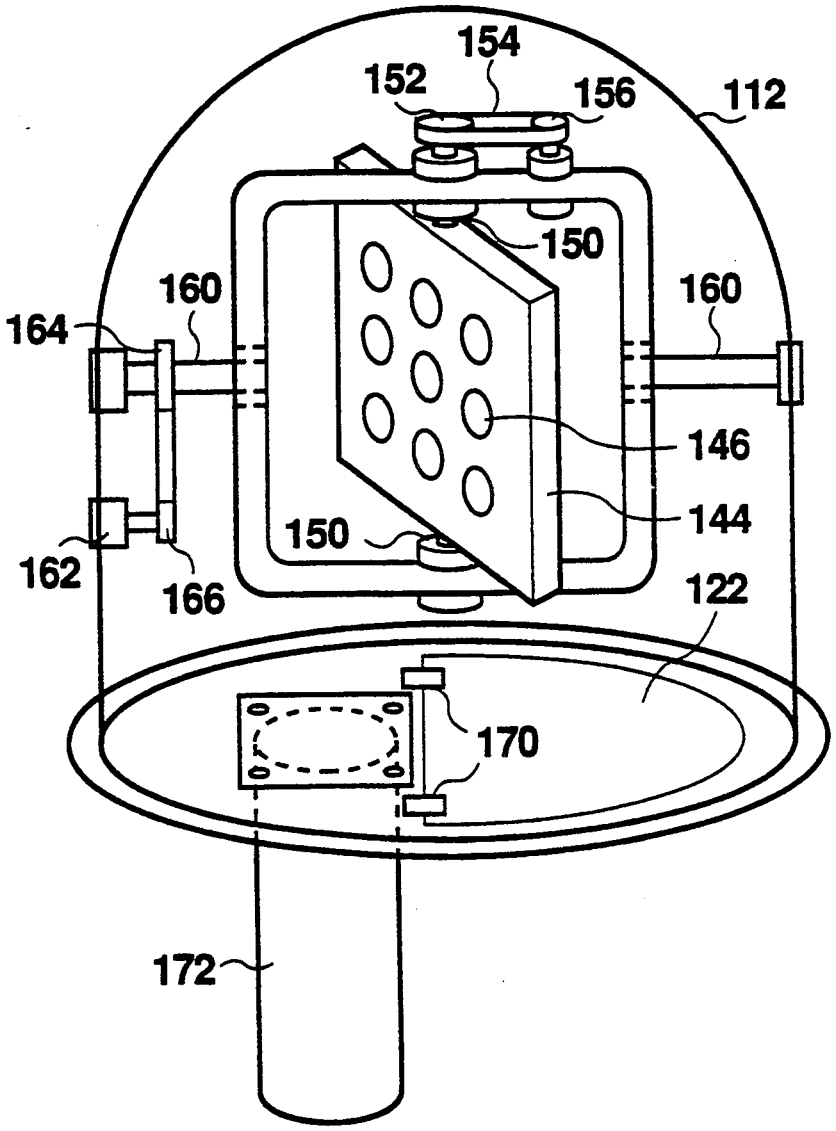
FIG. 4 is a perspective view showing the structure of a support member for the antenna system of FIG. 3.

As shown in FIG. 4, the radome 112 has an access hutch 122 on its base. Because the array antenna 144 is supported by the radome 112, no space for supporting the antenna is required on the radome base. When the small radome 112, examply 60 cm diameter and 60 cm in height, for housing the array antenna 144 of 40 cm×40 cm in size is used, a sufficient space can be obtained above the hutch 122 for maintenance and inspection. The access hutch 122 is opened and closed by a pair of hinges 170.

Since the entire antenna system housed in the radome is very light in weight, the radome bottom can be eccentrically supported by a post 172. Preferably the radome base and the top of the post 172 are connected by a reinforcing support to fasten them more firmly. A support member disclosed in the co-pending Japanese Utility Model Application Hei 2-89713 may be used for this purpose.

Figure 5:
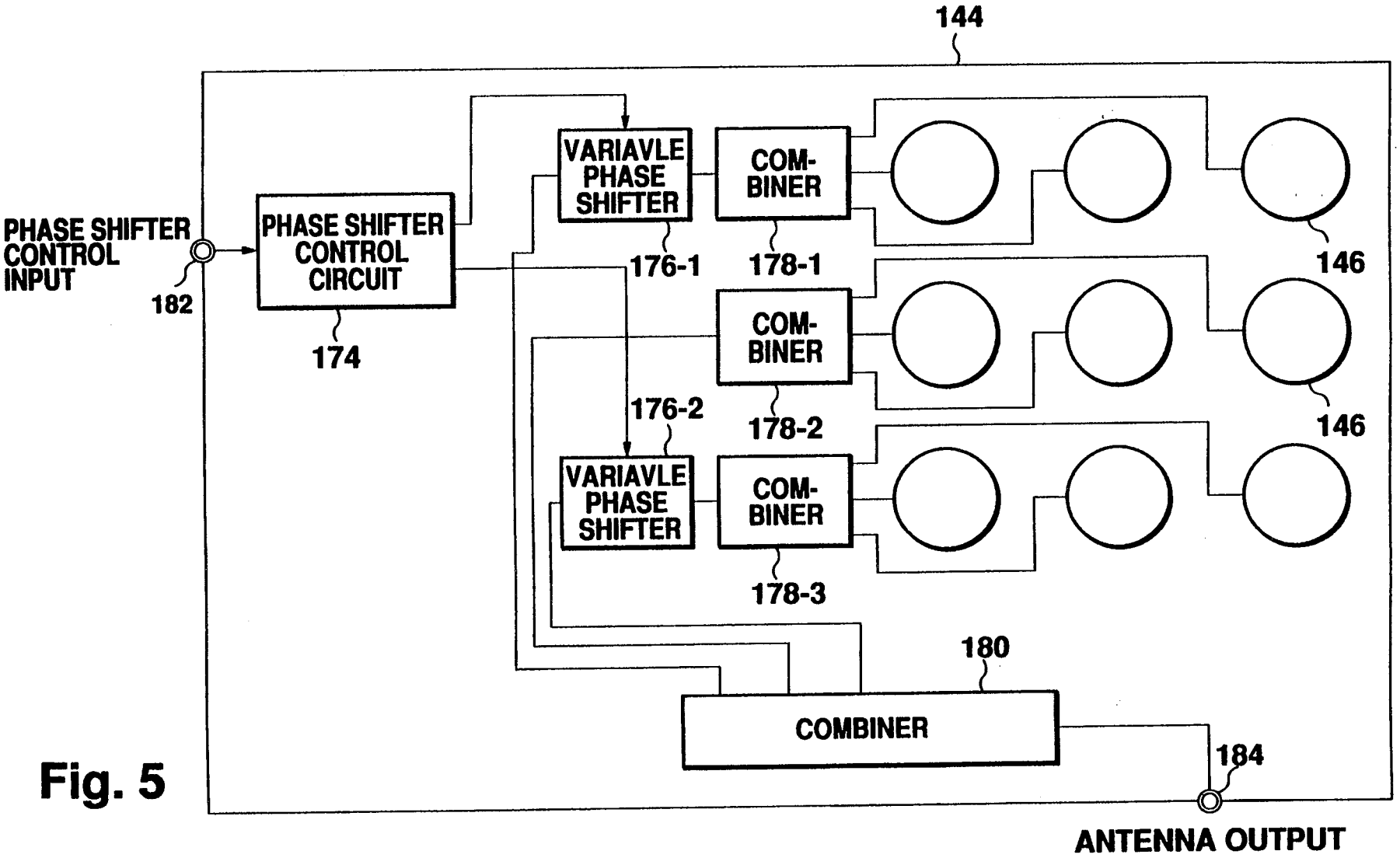
FIG. 5 is a block diagram showing the circuit configuration of an array antenna for the antenna system of FIG. 3.

FIG. 5 shows that the array antenna 144 includes not only the nine antenna elements 146 but also a phase shifter control circuit 174, phase shifters PS 176-1, 176-2, and combiners 178-1, 178-2, 178-3, 180.

The antenna elements 146 are arranged on a base plate in a predetermined pattern. Various types of the antenna elements 146 can be used for this invention. However, the array antenna 144 should have the antenna elements 146 arranged in a plurality of columns (which are perpendicular to the Y axis 150).

The base plate is usually superimposed via an insulator on a feeding plate on the rear side of the antenna elements 146. The components of the array antenna 144 except for the antenna elements 146 are mounted on the feeding plate.

The combiners 178-1, 178-2, 178-3 are respectively associated with the columns of the antenna elements 146. The combiners 178-1 to 178-3 combine outputs of the antenna elements 146 of the associated columns, supplying the combined outputs to the phase shifter PS 176-1, and combiner 180 or phase shifter PS 176-2. The number N of the antenna elements 146 in the respective columns is determined considering the required antenna gain. N is three in this embodiment.

The phase shifters PS 176-1,176-2 are respectively connected to the combiners 178-1, 178-3 associated with the antenna elements 146 in the top and bottom columns (as shown in FIG. 5). The phase shifters PS 176-1, 176-2 are controlled by a phase shifter control circuit 174. In response to a phase shifter control input from a terminal 182, the phase shifter control circuit 174 controls the amount of phase-shift for the phase shifter PS 176-1 to be 25° and that for the phase shifter PS 176-2 to be −25°. The phase shifters PS 176-1, 176-2 phase-shift the signals from the combiners 178-1, 178-3 according to the amount of phase shift necessary for control.

The outputs of the phase shifters PS 176-1, 176-2 are inputted to the combiner 180 as well as the combiner 178-2 associated with the central column of the antenna elements 146. The combiner 180 combines the inputs, supplying them as an antenna output to the non-illustrated receiver.

Figure 6:
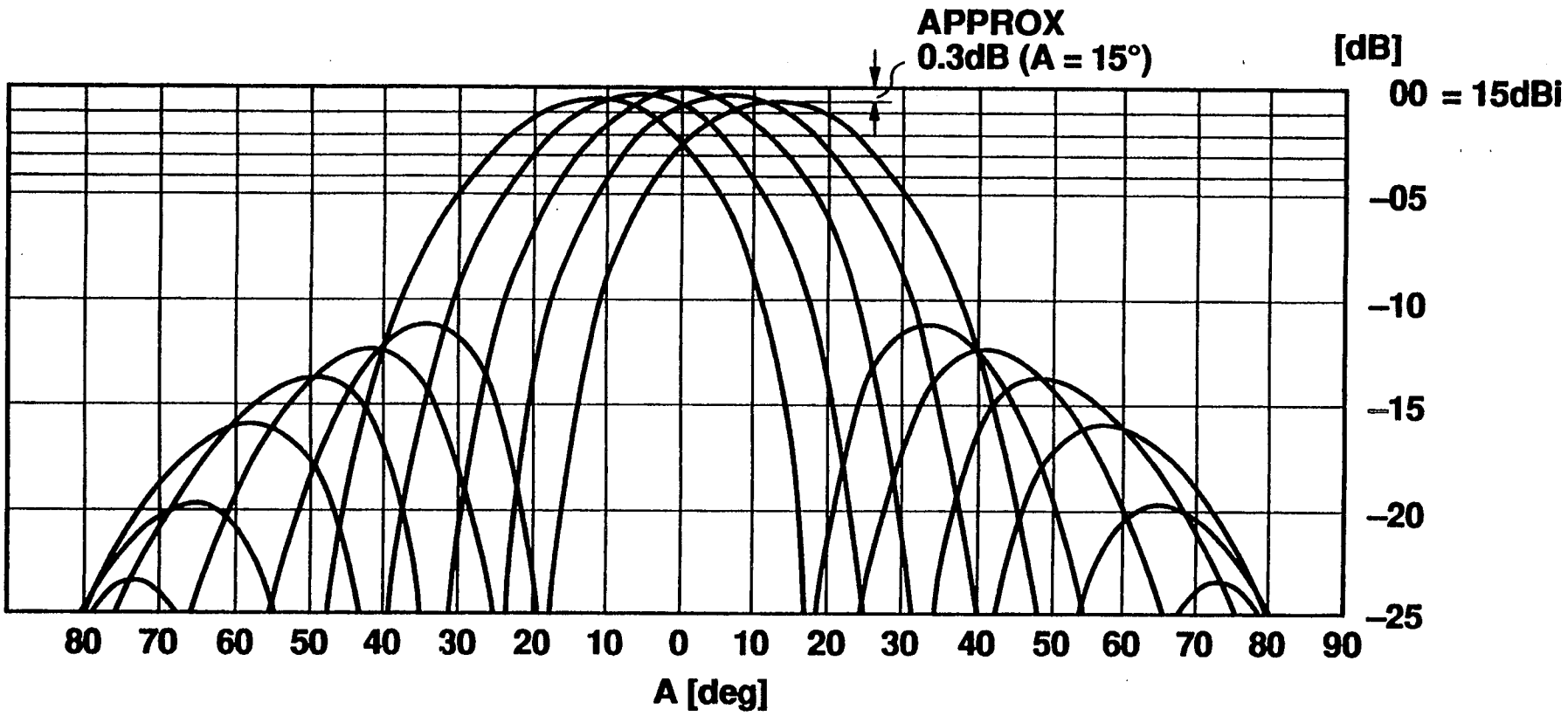
FIG. 6 shows radiation patterns of the array antenna, i.e. the directivity of the array antenna.

The configuration of the array antenna 144, particularly the configuration for phase shift, described above is for realizing the X2 axis electronically. FIG. 6 shows variations of the beam directivity determined by phase shift.

When the amount of phase shift is 0° in the phase shifters PS 176-1, 176-2, the beam from the array antenna 144 faces the direction perpendicular to the array antenna 144 (in the direction of 0°). As the amount of phase shift of the phase shifters PS 176-1, 176-2 is changed to ±25°, or ±50°, the the beam is steered accordingly. For ±50°, the beam is varied about −12°. The larger the amount of phase shift, the more the loss. (e.g. 0.3 dB for ±50°). Further, the steps of phase shift (25° in FIG. 6) and the number of positions to be designed depend upon the number of bits of the phase shifter control circuit 174. Three or four (3 or 4) positions are available for two bits, or five (5) to eight (8) positions are for three bits.

Figure 7:
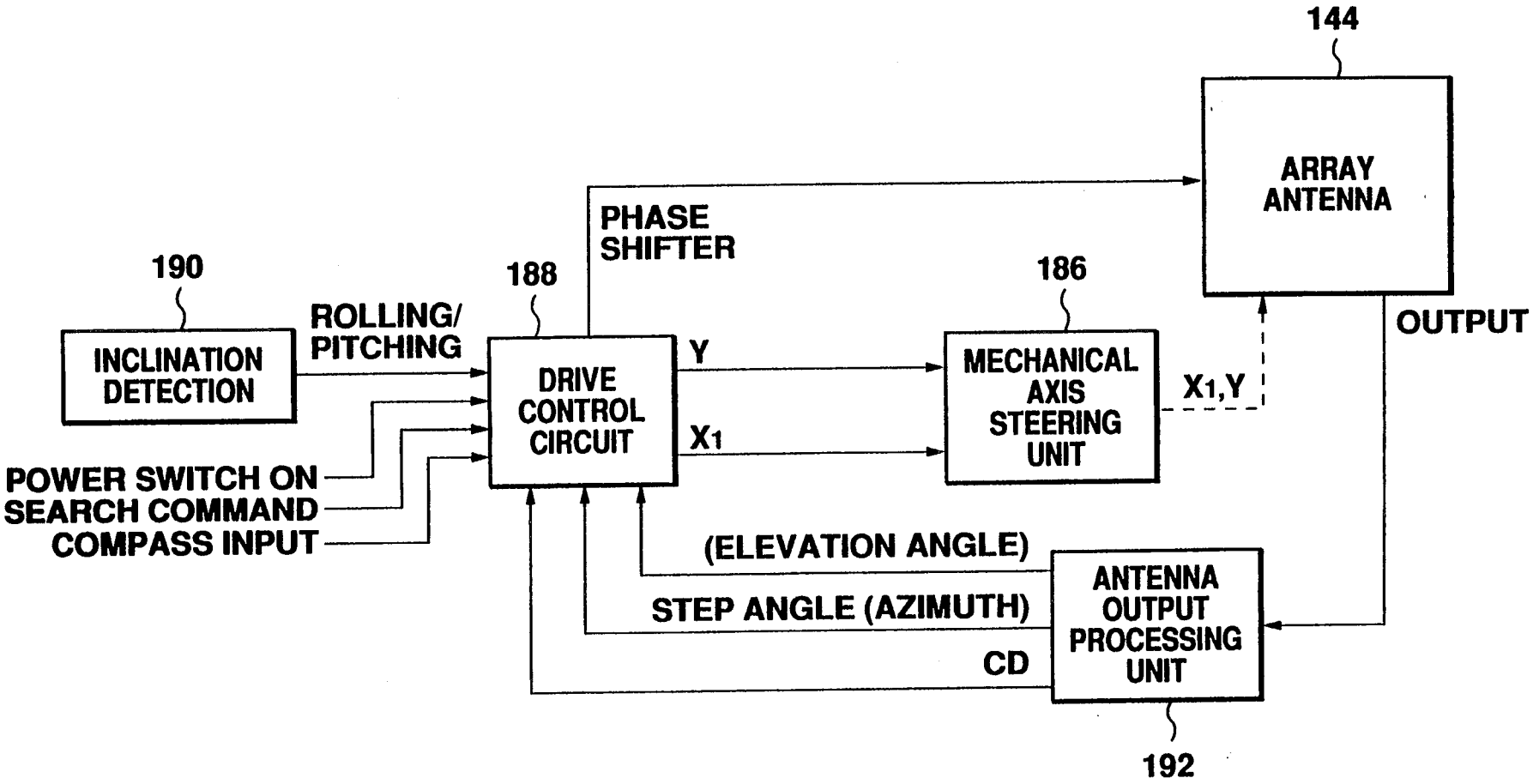
FIG. 7 is a block diagram showing the overall circuit configuration of the antenna system of FIG. 3.

FIG. 7 shows the overall circuit configuration of the antenna system in which the array antenna 144 is set in motion to realize the X1-Y-X2 mount antenna system.

The antenna system includes a mechanical axis steering unit 186 for steering the mechanical axes (X1 and Y axes 160, 150) of the array antenna 144, a drive control unit 188 for controlling the mechanical axis steering unit 186 and for supplying the phase shifter control input to the phase shifter control circuit 174 to steer the electronic axis (X2 axis), inclination detecting means 190 for detect the roll angle and the pitch angle of the moving platform and supplying the detected inclination angle to the drive control unit 188, and an antenna output processing unit 192 for processing the antenna output and supplying CD and step angles to the drive control unit 188 and so forth.

Figure 8:
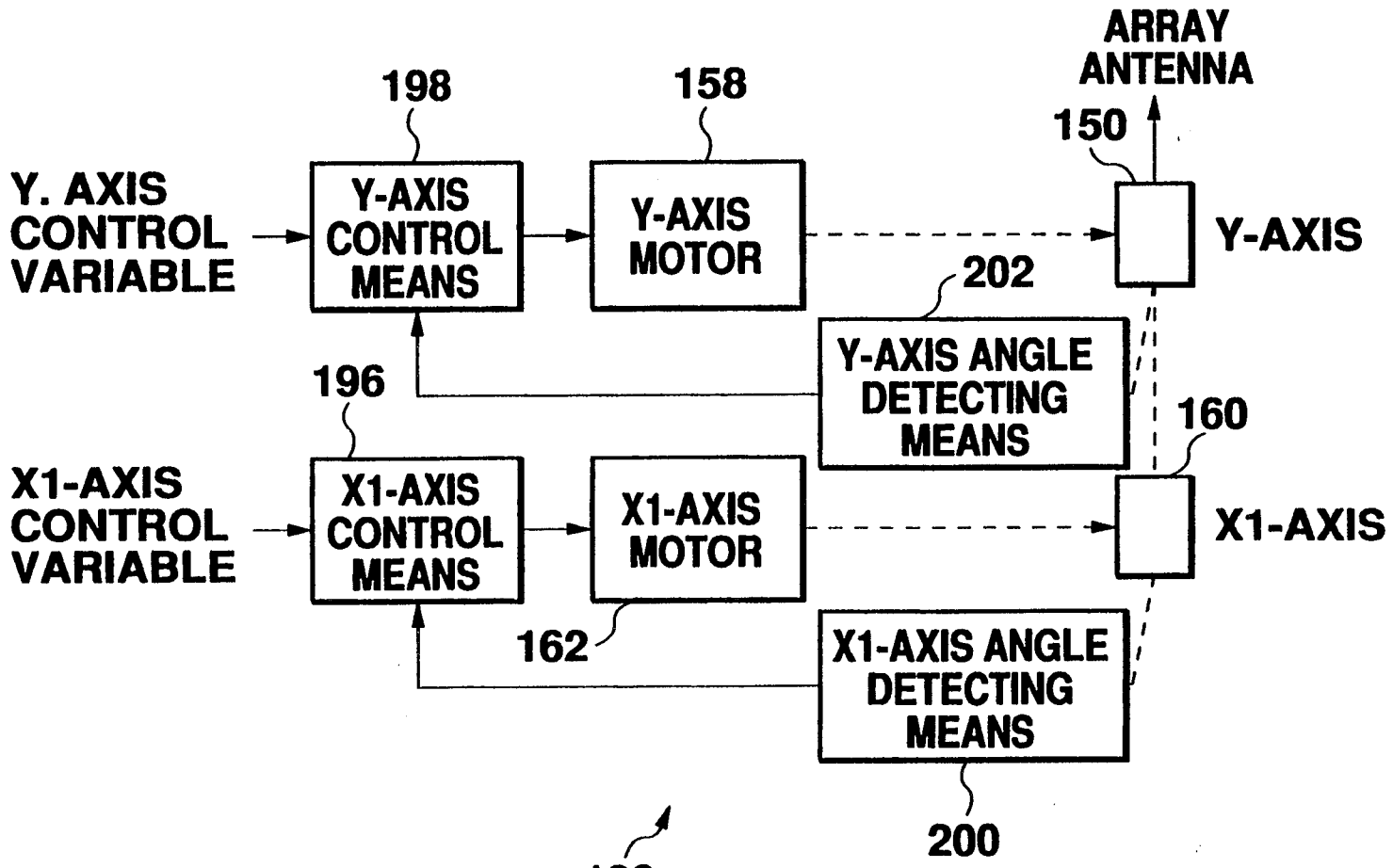
FIG. 8 is a block diagram of a mechanical axis steering unit.

As shown in FIG. 8, the mechanical axis steering unit 186 includes X1 and Y axis motors 162, 158 for respectively moving the X1 and Y axes 160, 150. These motors 162, 158 are attatched to the radome 112 and X1-axis frame 148, respectively.

The mechanical axis steering unit 186 includes an X1-axis control means 196 and Y-axis control means 198. These control means 196, 198 receive control variables for the X1 and Y axes from the drive control unit 188, controlling the operation of the X1- and Y-axis motors 162, 158 based on the received control variables as object values.

X1-axis angle detecting means 200 and Y-axis angle detecting means 202 are used to detect steering angles of the X1 and Y axes 160, 150. These means 200, 202 are rotary encoders, for example, supplying the detected values to X1- and Y-axis control means 196, 198, respectively. Respective servo control loops are formed for the X1 and Y axes by the detecting means 200, 202.

Figure 9:
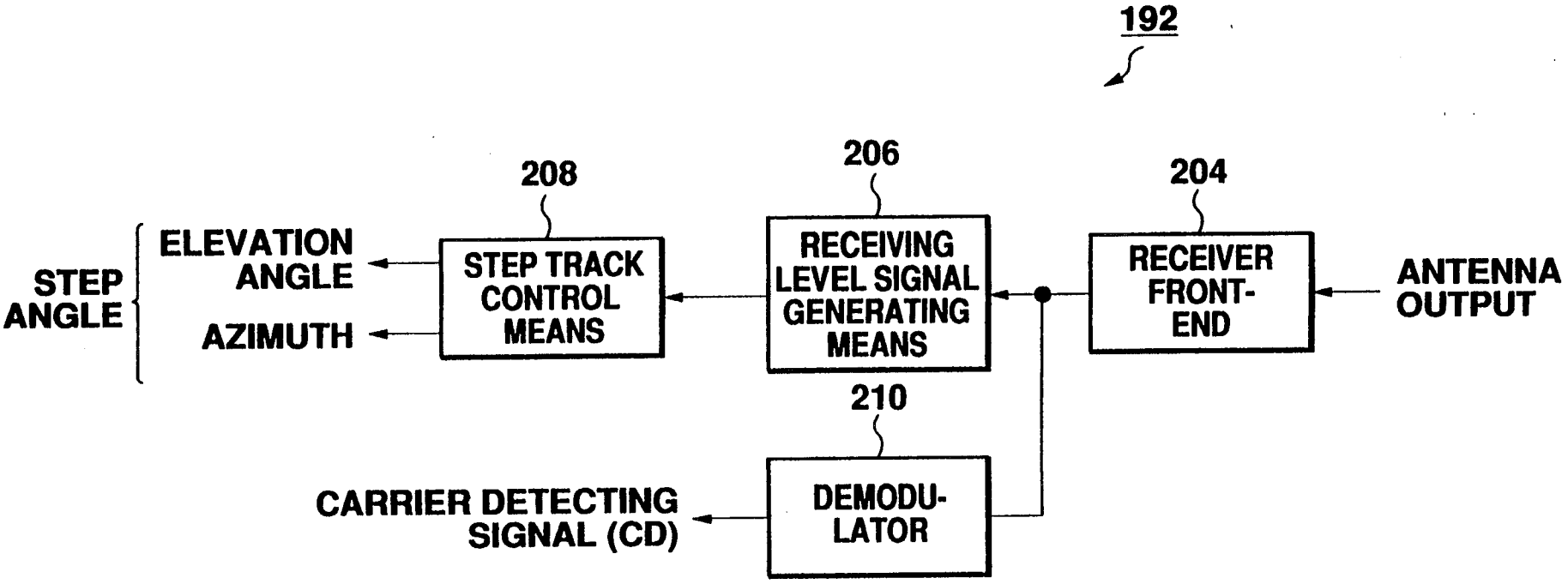
FIG. 9 is a block diagram showing the circuit configuration of an antenna output processing unit.

As shown in FIG. 9, the antenna output processing unit 192 includes a receiver front-end 204 for receiving an output from the array antenna 144. The receiver front-end 204 includes components such as low noise amplifiers LNA, part of which are mounted on the rear side of the array antenna 144. Since it is usually a signal with a minute level, the antenna output should be amplified to a predetermined level. Therefore, the receiver front-end 204 is positioned near the array antenna 144.

Receiving level signal generating means 206 is located behind the receiver front-end 204, generating a receiving level signal according to C/No (C: carrier power; No: noise power per Hz) of the output of the receiver front-end 204. The receiver front-end 204 converts the antenna output into a signal having much lower frequency, outputting it as an IF (Intermediate Frequency) signal. Receiving the IF signal, the receiving level signal generating means 206 estimates C/No according level of a carrier included in the IF signal, generating a receiving level signal which increases monotonously for C/No.

The receiving level signal is supplied to step track control means 208, which determines step angles based on the received signal.

In this embodiment, step angle for elevation and step angle for azimuth are determined. The step track control means 208 has the configuration as disclosed in Japanese Patent Applications Hei 2-175014 and Hei 2-240413 (hereinafter these are called as prior proposals).

A demodulator 210 is also located behind the receiver front-end 204. The demodulator 210 receives the IF signal from the receiver front-end 204, demodulating the signal, and supplying the demodulated data to a data terminal, for example.

In this embodiment, the demodulator 210 generates and outputs a carrier detection signal (CD) as well as performs fundamental function. The signal CD indicates whether or not a desired signal is being received at at least the predetermined level. The signal CD is generated by the well-known PLL (phase locked loop) method. The PLL method will not be described here.

Figure 10:
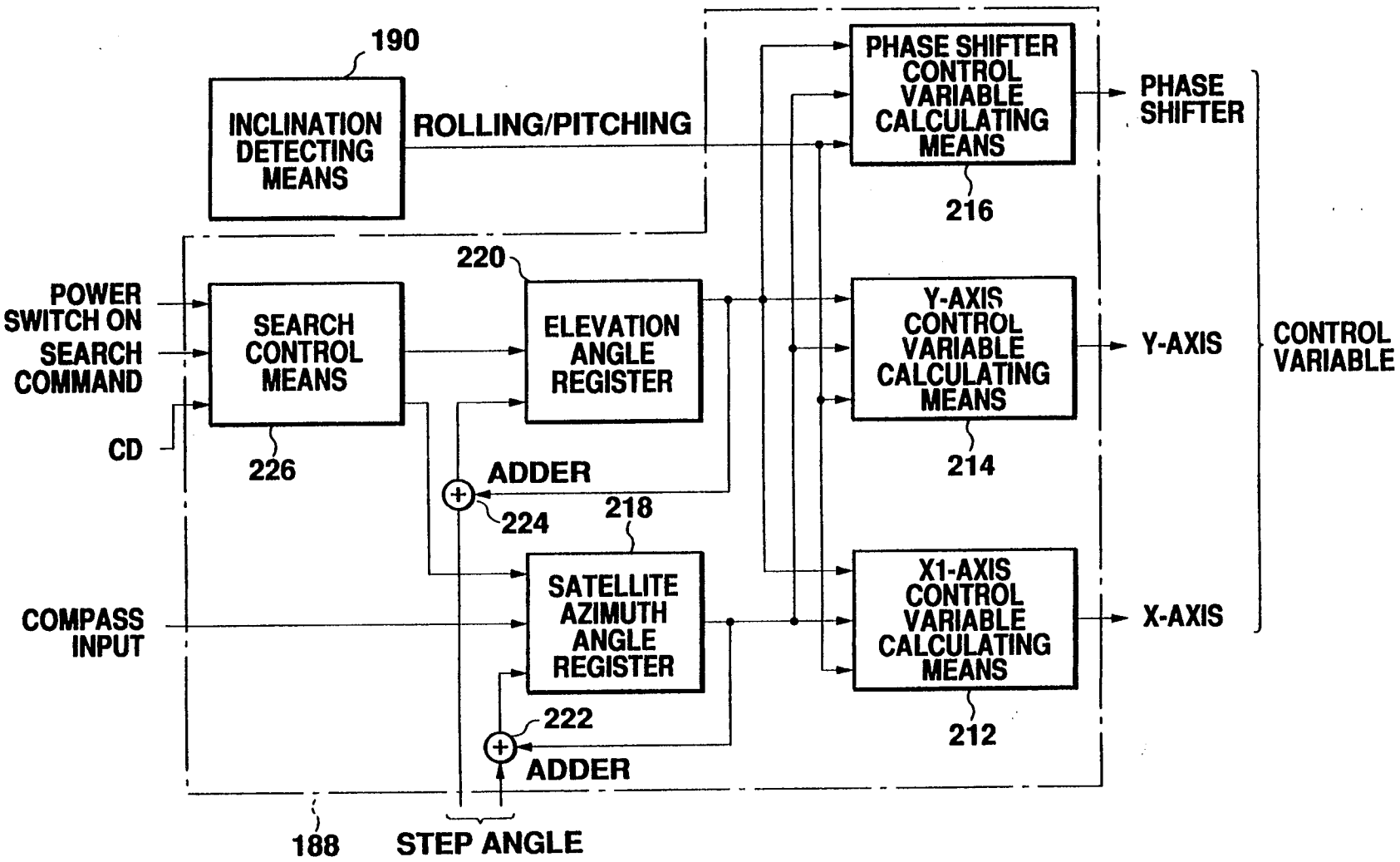
FIG. 10 is a block diagram showing a drive control unit.

FIG. 10 shows the configuration of the drive control unit 188. The drive control circuit 188 supplies a control variable to the mechanical axis steering unit 186, controlling the electronic axis by supplying a phase shifter control input to the phase shifter control circuit 174. For this purpose, the drive control circuit 188 includes X1-axis and Y-axis control variable calculating means 212, 214, and phase shifter control variable calculating means 216.

The X1-axis and Y-axis control variable calculating means 212, 214 calculate the X1-axis control variables to be supplied to the X1-axis and Y-axis control means 196, 198. The phase shifter control variable calculating means 216 calculates the phase shifter control input to be supplied to the phase shifter control circuit 174.

These calculating means 212, 214, 216 receive the data from satellite azimuth and elevation angle registers 218, 220, and the inclination detecting means 190.

The satellite azimuth angle register 218 stores a satellite azimuth angle, which is determined by non-illustrated means such as GPS (global positioning system). The satellite azimuth angle register 218 receives a compass input from a gyrocompass, for example. Thus, the azimuth angle of the ship and the azimuth angle of the satellite relative to the ship are determined. The satellite elevation angle register 220 stores the satellite elevation angle.

The calculating means 212, 214, 216 determine the control variables for the X1 and Y axes and the phase shifters, based on the satellite azimuth and elevation angle stored in the registers 218, 220. Thereafter, the array antenna 144 is controlled to direct its beam according to the azimuth and elevation angle of the satellite.

The contents of the satellite azimuth and elevation angle registers 218, 220 are added and updated according to the step angles supplied from the step track control means 208 so that the beam direction of the array antenna 144 is controlled to receive a signal having an optimum C/No. For this purpose, the drive control unit 188 includes an adder 222 for adding the step angle (azimuth angle) to the contents of the satellite azimuth angle register 218 and storing the added results in the register 218, and an adder 224 for adding the step angle (elevation angle) to the contents of the satellite elevation angle register 220 and storing the added results in the register 220.

In this embodiment, search control means 226 is used to search the azimuth and elevation angle of the satellite. Search angles related to the azimuth and elevation angle of the satellite are supplied to the satellite azimuth and elevation angle registers 218, 220. The search control means 226 has a circuit which is similar to the circuits disclosed in the prior proposals. Search is carried out immidiately after turning on the power supply, or according to a search command.

The inclination detecting means 190 is connected to the control variable calculating means 212, 214, 216. The inclination detecting means 190 detects roll angle and pitch angle of the ship. Based upon the detected roll and pitch angle, the control variable calculating means 212, 214, 216 calculate the control angel of the mechanical axes (X1 and Y axes 160, 150) and the electronical axis (X2 axis realized by the phase shifter 176) of the array antenna 144, stabilizing the antenna 144. Antenna stabilization angles are calculated based on the matrix equations described before with respect to the X1-Y-X2 mount. The X1 axis is adopted to stabilize against the rolling, and the Y and X2 axes are adopted to stabilize against the pitching. It is assumed that the maximum stabilization range of angle for the rolling is $\pm 25°$ and the range of angle for pitching is $\pm 15°$.

As described above, the antenna 144 can be composed without large number of phase shifters, thus the stabilized antenna system can be realized less expensively and easily without complicating the configuration of the array antenna 144 and phase shifters.

Figure 11:
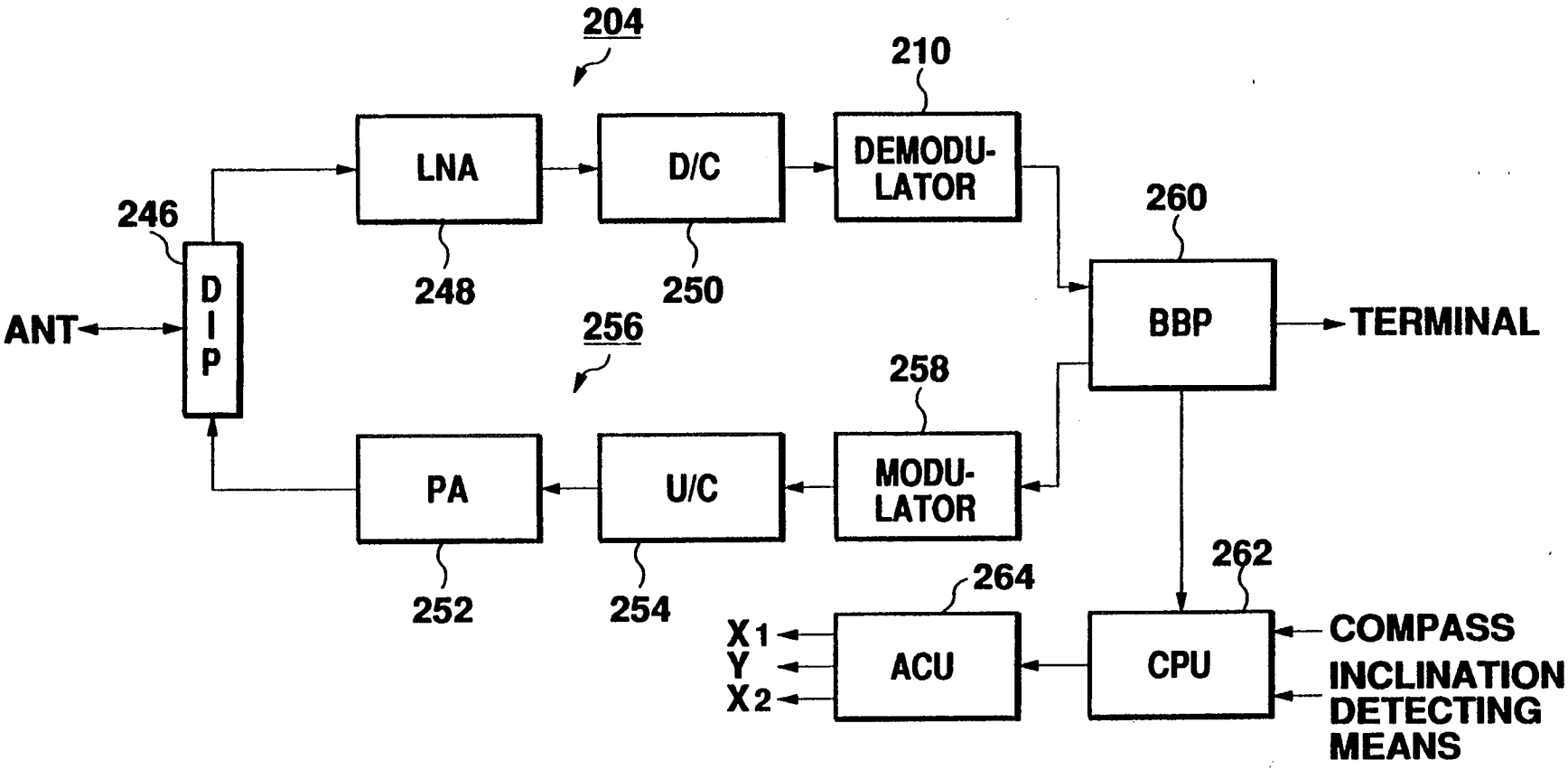
FIG. 11 is a block diagram showing the circuit configuration of the antenna system of the first embodiment having both transmitting and receiving functions.
Figure 12:
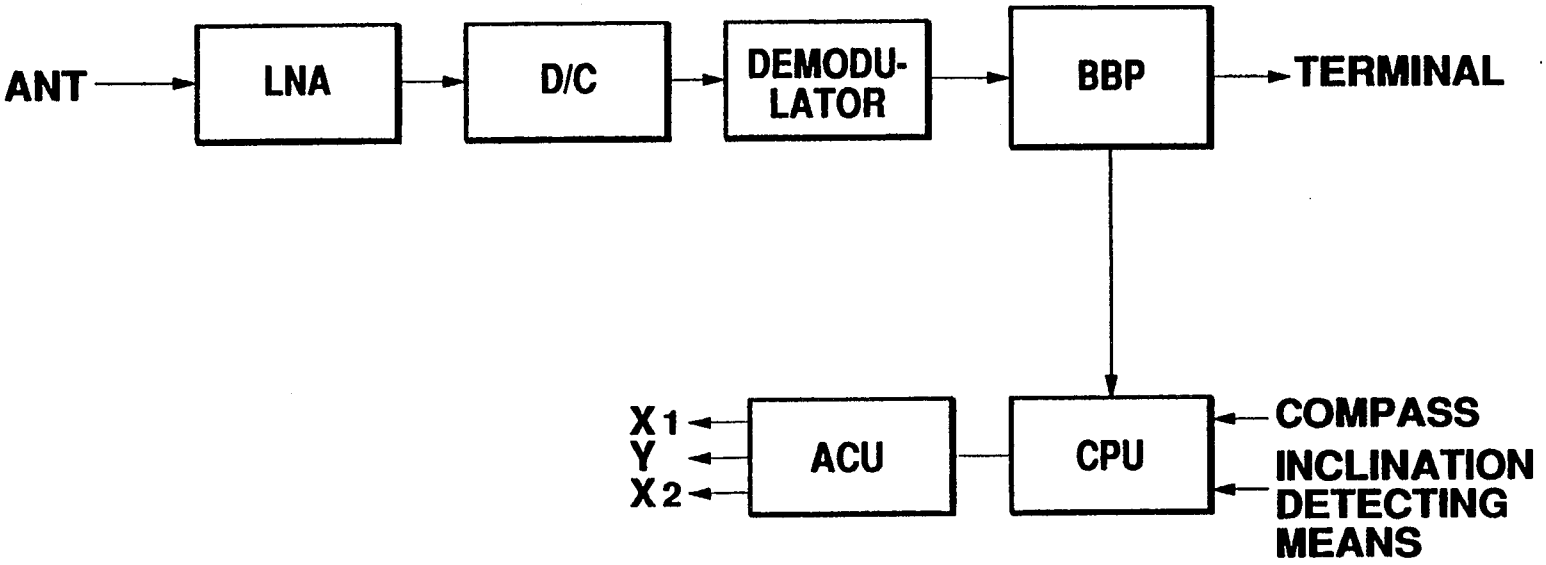
FIG. 12 is a block diagram showing the circuit configuration of the antenna system having only the receiving function.

FIG. 11 shows a circuit with both the transmitting and receiving functions, and FIG. 12 shows a circuit with only the receiving function.

As shown in FIG. 11, a diplexer DIP 246 is used to apply the array antenna 144 to both transmission and reception. The receiver front-end 204 includes a low noise amplifier LNA 248 and a down-converter (D/C) 250. A low noise amplifier LNA 248 carries out low-noise-amplification of the antenna output, and the down-converter 250 converts the antenna output into an IF signal. A transmitter 256 is composed of power amplifier PA 252 and an up-converter (U/C) 254. A modulator 258 is positioned upstream of the transmitter 256.

Output of the demodulator 210 and input side of the modulator 258 are both connected to a base band processor (BBP) 260. The BBP 260 transmits and receives signals to and from the terminal, performing the processing related to the base band signal.

CPU 262 and ACU (antenna control unit) 264 are connected to the BBP 260 in the named order. ACU 264 is controls the steering of the X1 axis 160, Y axis 150 and X2 axis. CPU 262 calculates the control variables for controlling the antenna system and send them to ACU 264.

FIG. 12 shows an example of a circuit to be used only for reception. Accordingly, a standard configulation for the satellite communication including both of transmitting and receiving functions is shown in FIG.11. The system configulation shown in FIG.12 is a standard one of the ship-borne satellite broadcasting receiver which requires only receiving.

Figure 13:
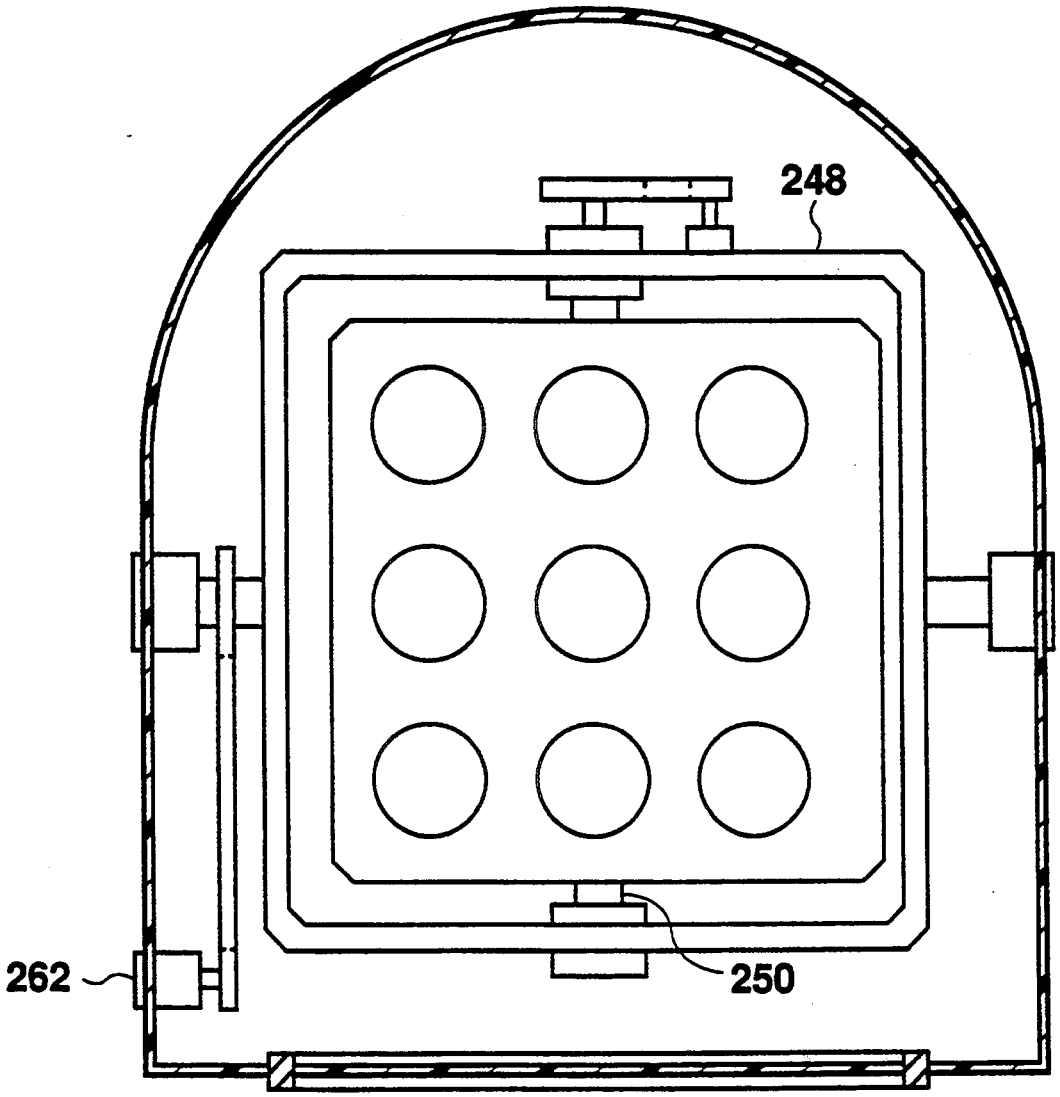
FIG. 13 is a cross-sectional view showing the structure of a stabilized antenna system according to a second embodiment.

FIG. 13 shows the structure of an antenna system according to a second embodiment of this invention.

In the second embodiment, the X1-axis motor 262 is located at a position lower than the position of the X1-axis motor of the first embodiment, more precisely is located below the lower part of the X1-axis frame 248.

With this arrangement, a motor of relatively larger size can be used, and the antenna system can be designed more freely. Specifically, when it is angularly moved, the X1-axis frame 248 does not contact or collide with the large X1-axis motor 262. In the first embodiment, the X1-axis motor 162 should be small enough to prevent contact or collision with the X1-axis frame. No such consideration is required in the second embodiment.

Figure 14:
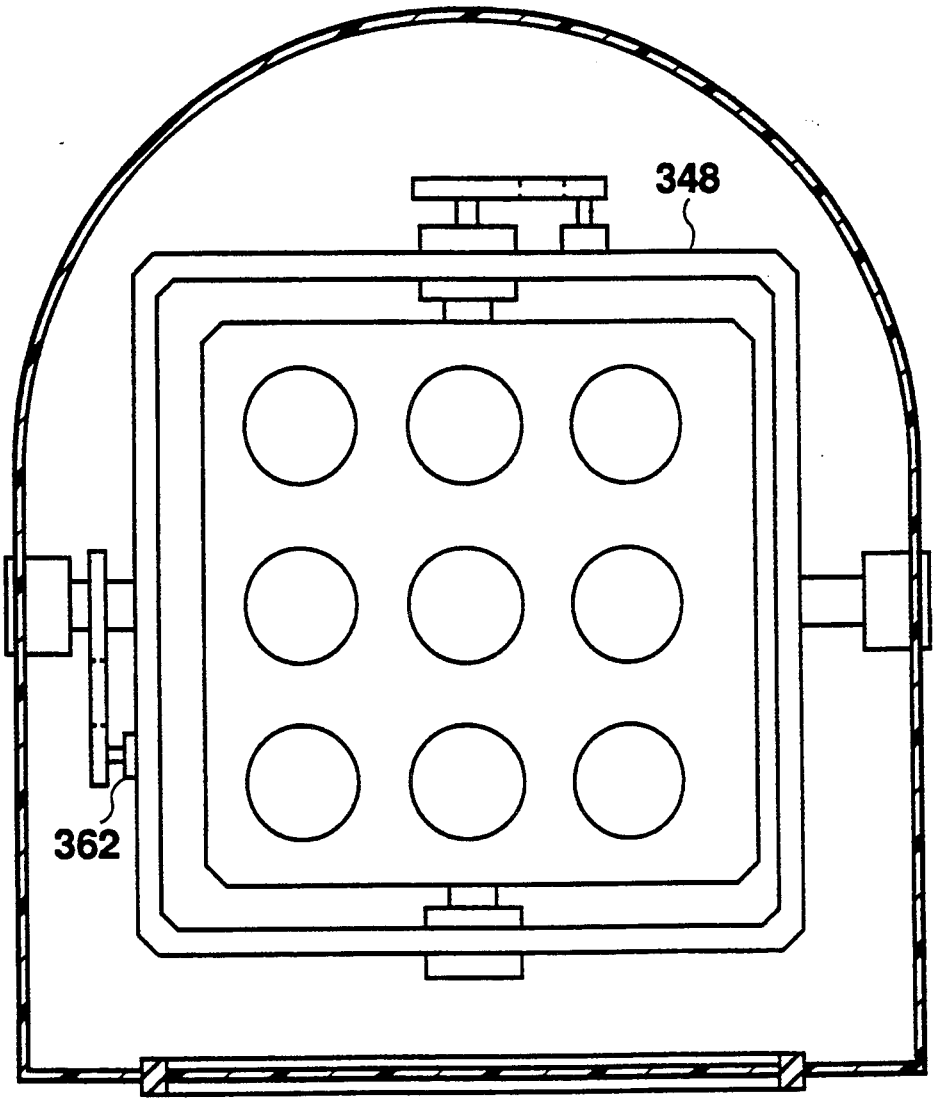
FIG. 14 is a cross-sectional view showing the structure of a stabilized antenna system according to a third embodiment.

FIG. 14 shows the structure of an antenna system according to a third embodiment of the invention. In this embodiment, the X1-axis motor 362 is mounted on the X1-axis frame 348. This arrangement can offer the advantageous result similarly to the first embodiment.

Figure 15:
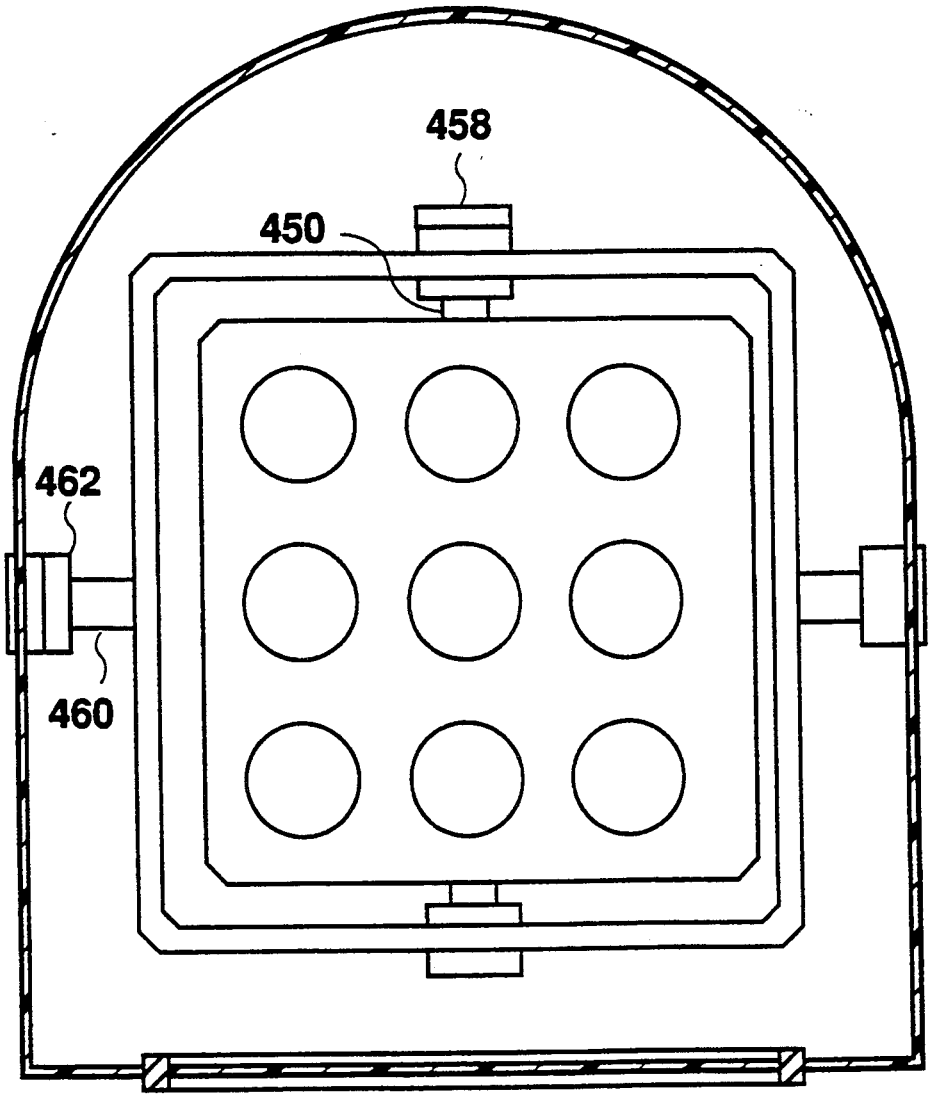
FIG. 15 is a cross-sectional view showing the structure of a stabilized antenna system according to a fourth embodiment.

A fourth embodiment of this invention is shown in FIG. 15. In this case, the X1-axis motor 462 is attached to the X1 axis 460, and the Y-axis motor 458 is attached to the Y axis 450. In other words, the X1-axis and Y-axis motors 462, 458 directly steer the X1 and Y axes 460, 450. This arrangement is also advantageous as the arrangement of the first embodiment.

Figure 16:
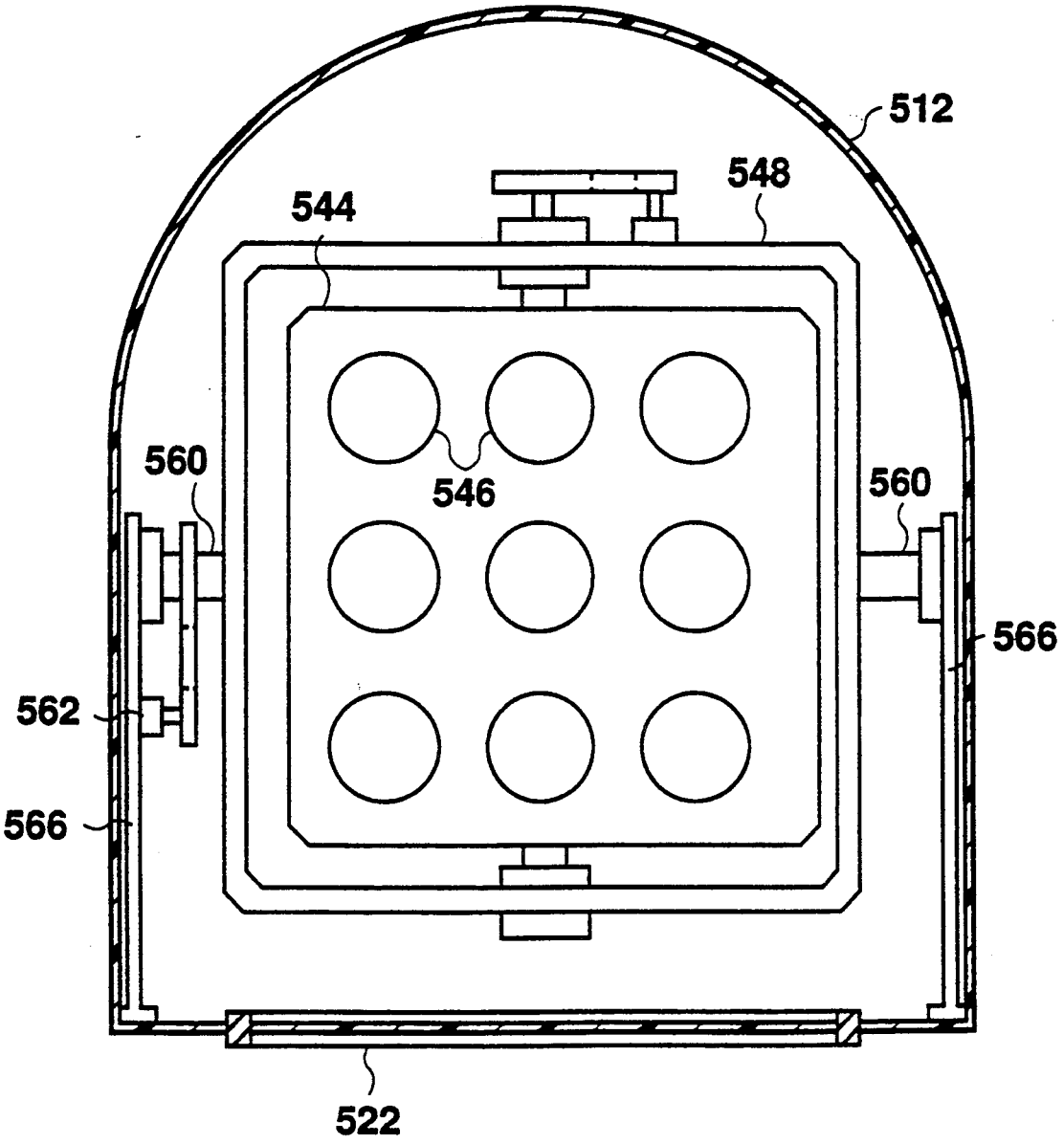
FIG. 16 is a cross-sectional view showing the structure of a stabilized antenna system according to a fifth embodiment.

FIG. 16 shows the structure of an antenna system according to a fifth embodiment of this invention. In this embodiment, the X1 axis 560 and X1-axis motor 562 are attached to legs 566 instead of the radome 512. The legs 566 are made of non-conductive material such as resin, and are designed to minimize the interferrences for reception and/or transmission via the array antenna 544. The legs 566 are fastened to peripheral portions of the base of the radome 512 not to interfere with the access hutch 522. This arrangement is as advantageous as the arrangement of the first embodiment. The X1-axis motor 562 may be attached to the X1-axis frame 548.

Although the foregoing description is related to the antenna system of the X1-Y-X2 mount type, this invention is also applicable to the antenna system of the Y1-X-Y2 mount type.

Variable phase shifters are used in the foregoing embodiments, but fixed phase shifters whose amount of phase shift is predetermined can also be used together with the variable phase shifters.

Figure 17:
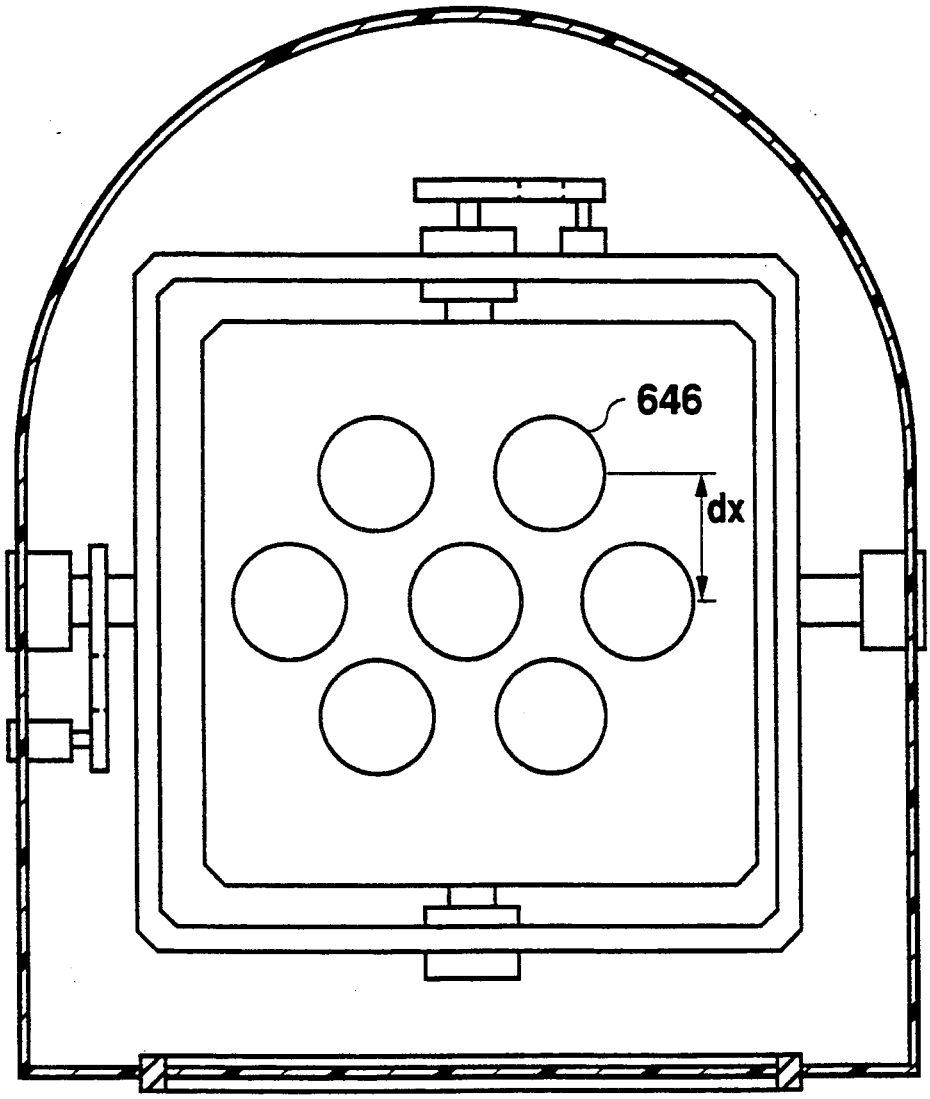
FIG. 17 is a cross-sectional view showing the structure of a stabilized antenna system according to a sixth embodiment.
Figure 18:
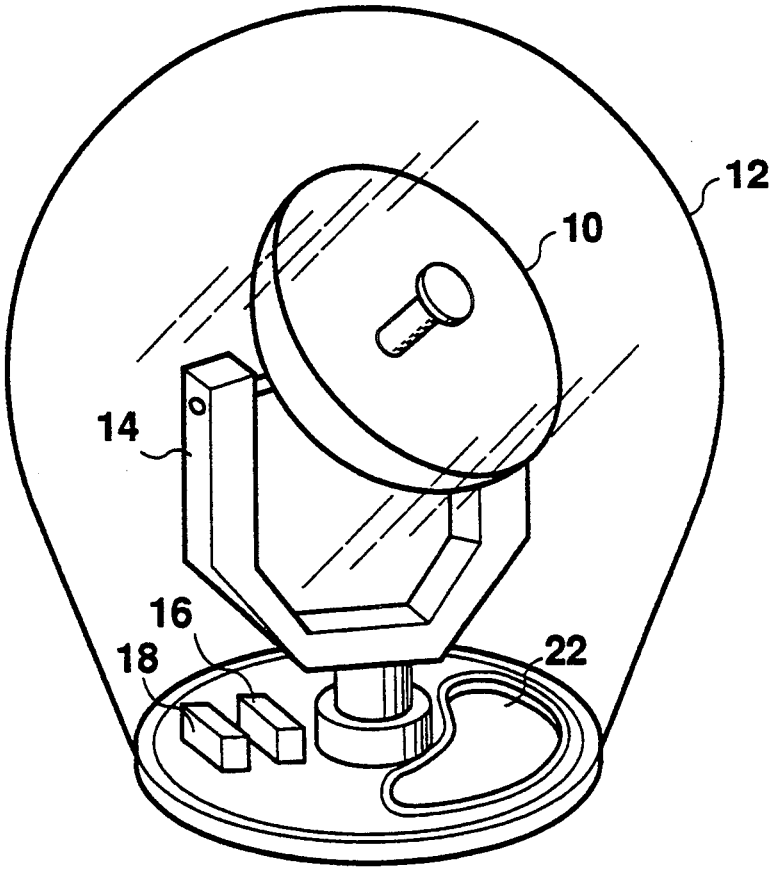
Fig. 18 PRIOR ART
FIG. 18 is a perspective view showing a first conventional antenna system.
Figure 19:
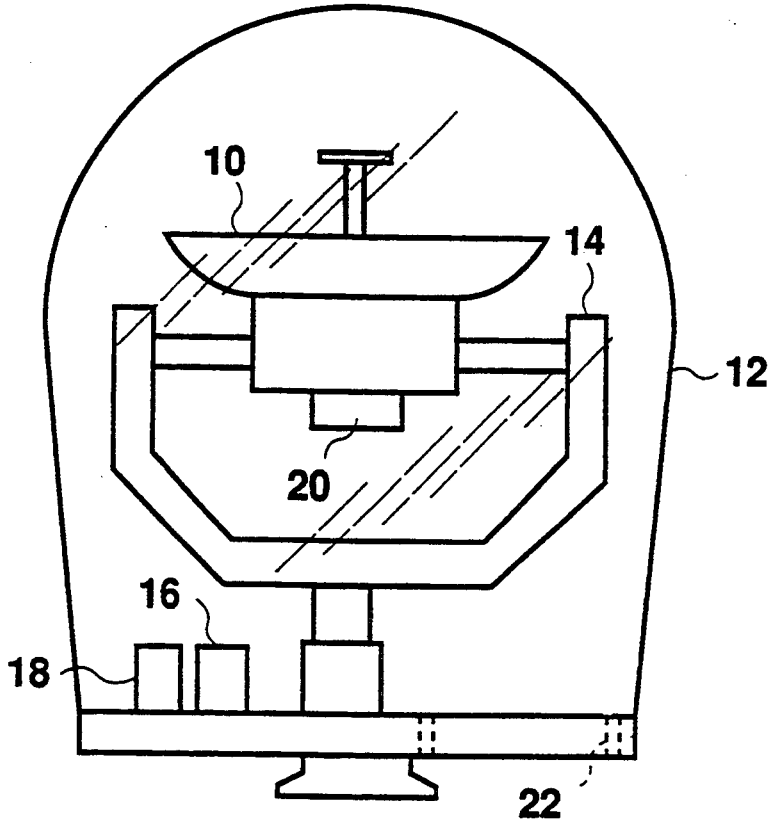
Fig. 19 PRIOR ART
FIG. 19 is a side cross-sectional view of the antenna system of FIG. 18.
Figure 20:
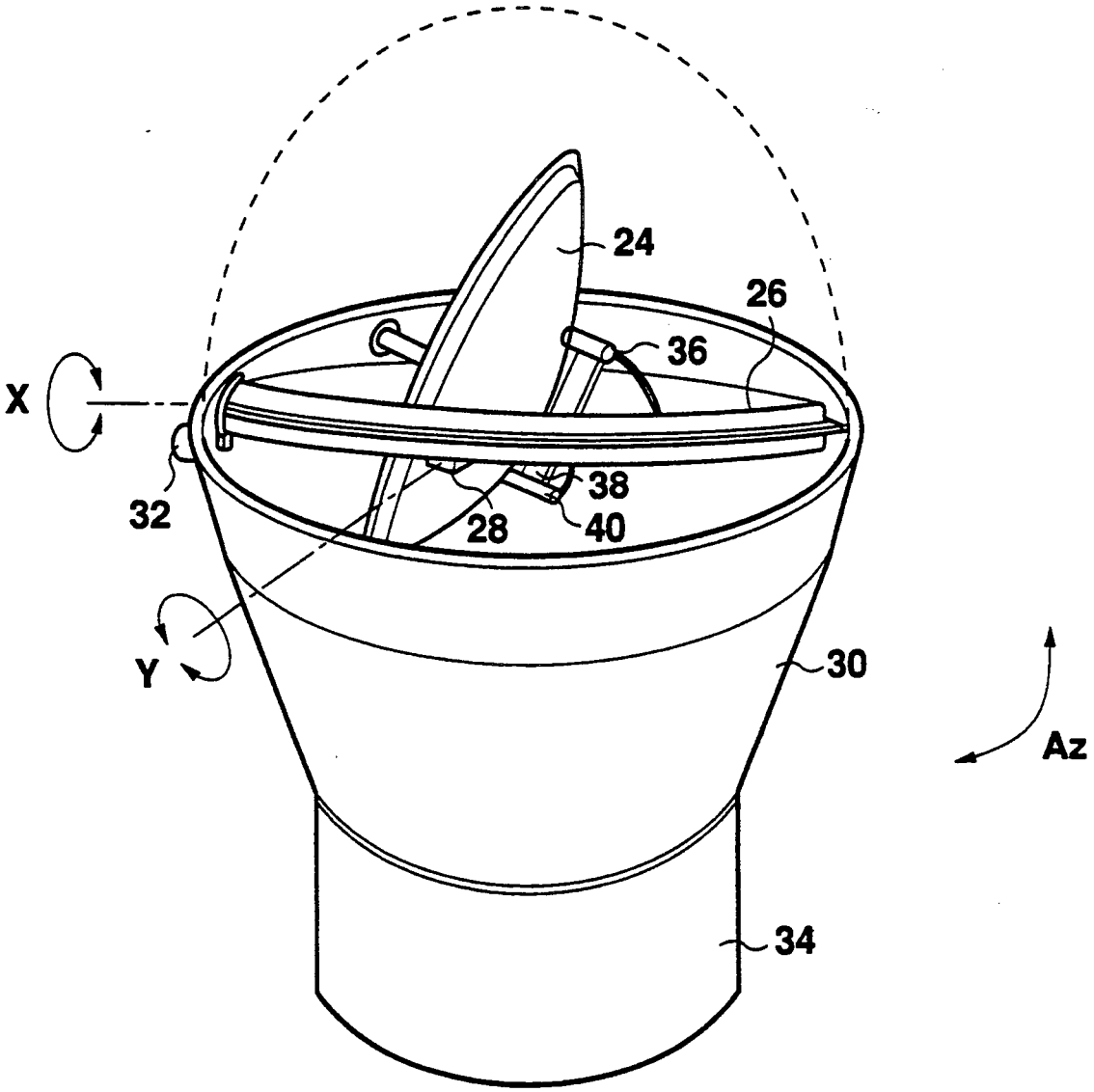
Fig. 20 PRIOR ART
FIG. 20 is a perspective view showing a second conventional antenna system.
Figure 21:
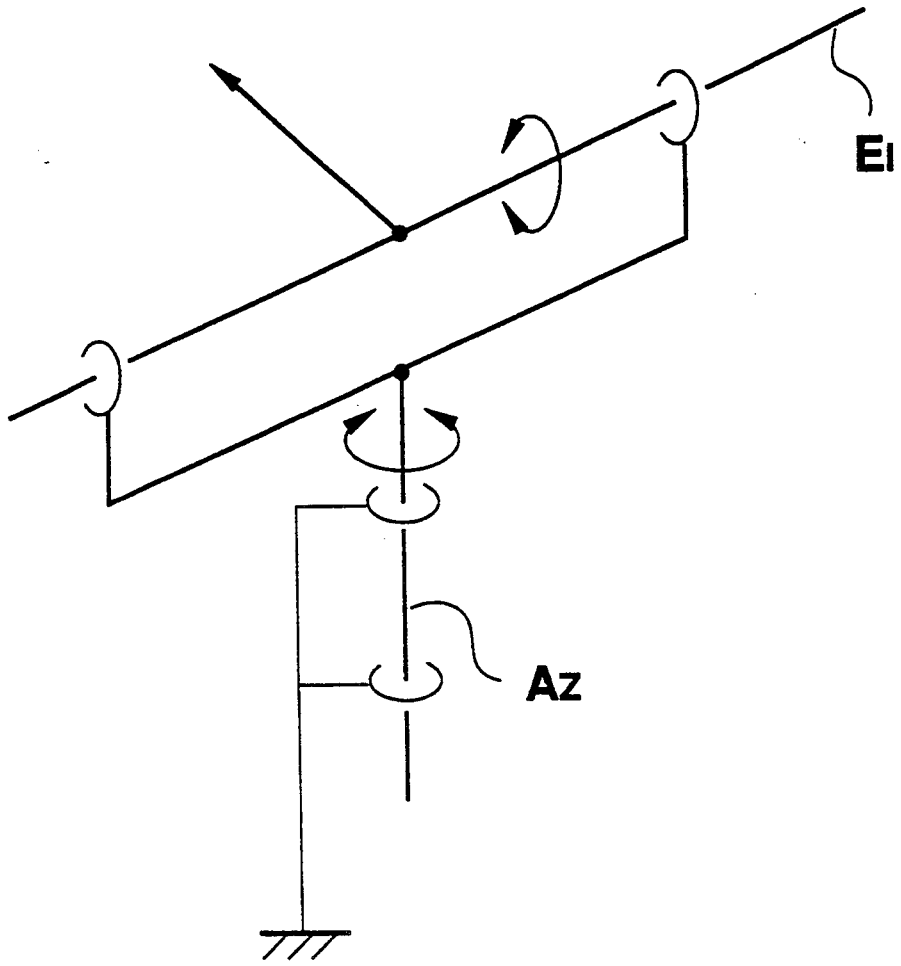
Fig. 21 PRIOR ART
FIG. 21 shows the configuration of the axes of the third conventional antenna system.
Figure 22:
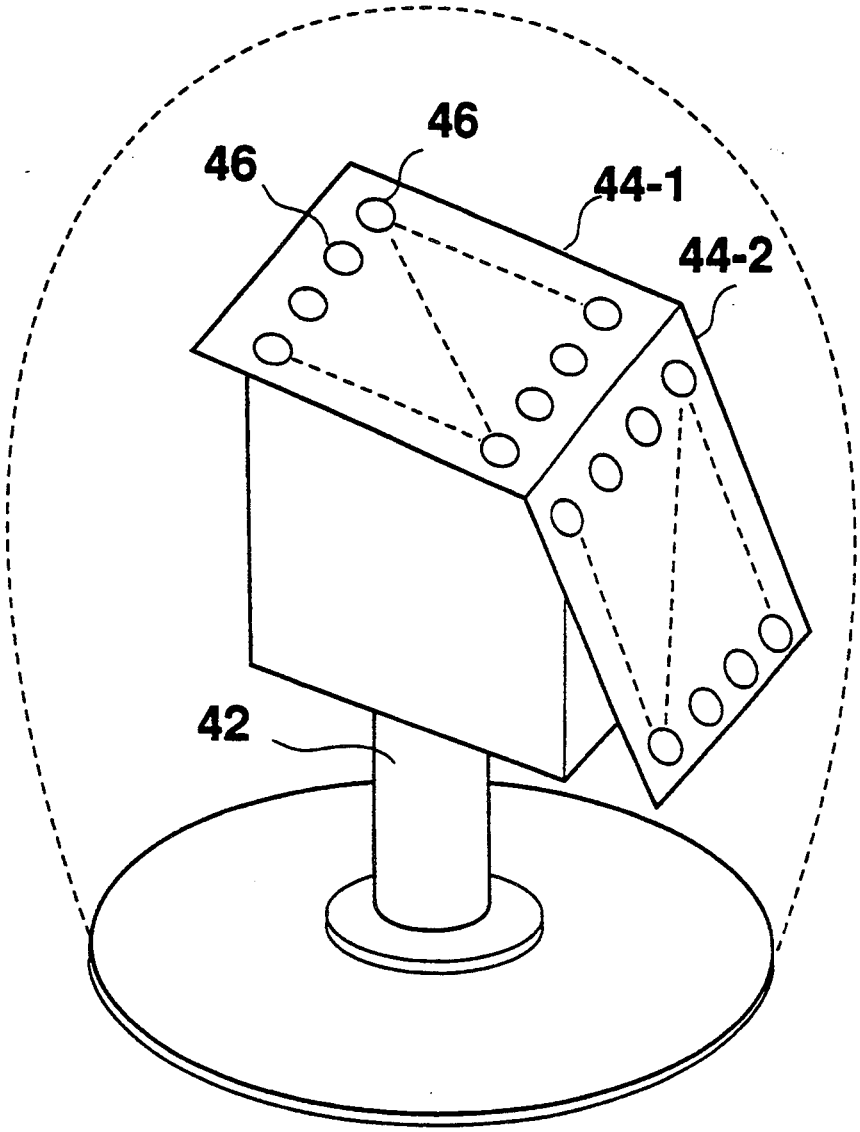
Fig. 22 PRIOR ART
FIG. 22 is a perspective view of a fourth conventional antenna system.

Although the antenna elements are linearly arranged in the columns and columns, they may be arranged in other patterns. According to this invention, the antenna elements should be arranged at least along lines perpendicular to the directions to change directivity of the beams. However, it is not necessary to arrange the antenna elements orderly along the directions other than along the beam steering axis. In other words, an antenna element group connected to a first phase shifter and another antenna element group belonging to a second phase shifter may be arranged in a staggered manner. For instance, as shown in FIG. 17, the antenna elements 646 may be arranged in a staggered (2, 3, 2) pattern. The distance dx between one column and in an adjacent column may be equal to or smaller than $0.6\lambda$, where $\lambda$ stands for wavelength, thereby successively suppressing sidelobes.

This invention can stabilize the antenna against inclinations such as rolling and pitching of the moving platform where the antenna system is installed. Specifically, with the X1-Y-X2 mount, steering $\epsilon 1$ of the X1 axis offsets for the rolling r, and steerings $\eta$ and $\epsilon 2$ of the Y and X2 axes offset for the pitching xp, yp, zp. With the Y1-X-Y2 mount, steering $\eta 1$ of the Y axis offset for the pitching p, and steerings $\epsilon$ and $\eta 2$ of the X and Y2 axes offset for the rolling xr, yr, zr.

The antenna system can operate reliably by one electronic axis and two mechanical axes. Since only one axis is electronic, it is not necessary to use a complicated antenna with large number of phase shifters, thereby producing the antenna system less expensively.

While tracking the satellite based on an azimuth and elevation angle of the satellite, inclination of the moving platform can be offset based on the data detected by the inclination detecting means.

Since the first and second antenna steering means form servo control loops, the mechanical axes can be controlled reliably and promptly.

The antenna elements arranged in 2 or 3 columns and in N columns enable a small number of phase shifters to realize an electronic axis easily and less expensively.

Part of the receiver components are mounted on the antenna base plate to improve signal receiving function.

Further the frame is made of plastic material to prevent deterioration of the antenna properties.

The antenna and its related components are supported at the side of the radome or by the legs made of resin without using metal legs not to adversely affect the antenna properties.

The access hutch facilitates inspection and maintenance of the antenna and its related components. Further, the access hutch is located Just below the antenna. Therefore, even when both the antenna and radome are small, inspection and maintenance work can be performed easily.

What is claimed is:

1. A stabilized antenna system to be installed on a moving platform, comprising:

(a) an array antenna including (i) a plurality of antenna elements arranged in a plurality of columns, and (ii) variable phase shifters associated with at least respective columns of said antenna elements and being adopted to phase-shift high frequency signals related to said antenna elements in the columns associated therewith, thereby steering a beam of said antenna electronically around a virtual axis, (b) first antenna steering means for steering said array antenna around first mechanical axis perpendicular to the virtual axis for steering the beam by said variable phase shifters;

(c) second antenna steering means for steering said array antenna and said first antenna steering means around second mechanical axis perpendicular to the first mechanical axis;

(d) inclination detecting means for detecting inclination angle of the moving platform;

(e) control means for controlling said variable phase shifters end said first and second antenna steering means according to the detected inclination angle so that the beam of said array antenna is directed toward a satellite;

(f) a radome for covering at least said array antenna and said first and second antenna steering means, and being made of material passing the radio waves; and (g) a frame for supporting said first antenna steering means, said frame being mainly made of resin and being supported at the side of said radome.

2. An antenna system according to claim 1, wherein said control means further includes (i) phase shifter control variable calculating means for calculating control variables for said phase shifters based on satellite azimuth angle, satellite elevation angle and inclination angle of the moving platform, and for controlling the amounts of phase shift for said variable phase shifters, (ii) first mechanical axis control variable calculating means for determining control variables for said first antenna steering means to steer said array antenna based on the satellite azimuth angle, the satellite elevation angle and the inclination angle of the moving platform, and (iii) second mechanical axis control variable calculating means for determining control variables for said second antenna steering means to steer said array antenna and said first antenna steering means, based on the satellite azimuth angle, the satellite elevation angle and the inclination angle of the moving platform.

3. An antenna system according to claim 1, wherein said first antenna steering means further includes (i) a first mechanical axis motor for steering said array antenna, (ii) first mechanical axis angle detecting means for detecting an angular position of said first mechanical axis motor, and (iii) first mechanical axis control means for controlling in a servo loop said first mechanical axis motor according to the angular position of said first mechanical axis motor detected by said first mechanical axis angle detecting means.

4. An antenna system according to claim 1, wherein said second antenna steering means further includes (i) a second mechanical axis motor for steering said first antenna steering means and said array antenna, (ii) second mechanical axis angle detecting means for detecting an angular position of said second mechanical axis motor, and (iii) second mechanical axis controlling means for controlling in a servo loop said second mechanical axis motor based on the angular position of said second mechanical axis motor detected by said second mechanical axis angle detecting means.

5. An antenna system according to claim 1, wherein said array antenna further includes (i) combiners for combining signals received by said antenna elements and being located near said antenna elements, and (ii) a receiver front-end for receiving the signals combined by said combiners and being located near said antenna elements and said combiners.

6. An antenna system according to claim 1, further including (i) a support for supporting said radome thereon and eccentrically positioned below a radome base, and (ii) an access hutch located on said radome base at a position just below said array antenna.

7. A stabilized antenna system according to claim 1, wherein said antenna elements are arranged in an odd number of columns and said variable phase shifters are associated with at least respective columns of said antenna elements except for central column of said antenna elements.

8. A stabilized antenna system according to claim 1, wherein said antenna elements are arranged in a staggered. manner.

9. A stabilized antenna system according to claim 8, wherein said antenna elements are arranged in an odd number of columns, said variable phase shifters are associated with at least respective columns of said antenna elements except for a central column of said antenna elements, and a number of said antenna elements in the central column is greater than that in each of outer columns.

* * * * *